US006341708B1

(12) United States Patent
Palley et al.

(10) Patent No.: US 6,341,708 B1
(45) Date of Patent: Jan. 29, 2002

(54) BLAST RESISTANT AND BLAST DIRECTING ASSEMBLIES

(75) Inventors: Igor Palley, Madison; Gary Allan Harpell, Morristown; Max Wilhelm Gerlach, Hackettstown, all of NJ (US)

(73) Assignee: AlliedSignal Inc., Morristown, NJ (US)

( * ) Notice: Subject to any disclaimer, the term of this patent is extended or adjusted under 35 U.S.C. 154(b) by 0 days.

(21) Appl. No.: 09/322,604

(22) Filed: May 28, 1999

Related U.S. Application Data

(63) Continuation-in-part of application No. 08/852,754, filed on May 7, 1997, which is a continuation-in-part of application No. 08/717,042, filed on Sep. 20, 1996, which is a continuation-in-part of application No. 08/533,589, filed on Sep. 25, 1995.

(51) Int. Cl.[7] ..... B65D 6/36; F42B 39/14

(52) U.S. Cl. ..... 220/1.5; 206/3; 206/584; 220/6; 229/122.32; 229/122.34

(58) Field of Search ..... 229/122.23, 122.34, 229/122.32, 103.3, 122.2; 220/229, 1.5, 1.6, 96, 9.1, 9.2; 109/49.5, 15, 80, 83, 84; 206/3, 584

(56) References Cited

U.S. PATENT DOCUMENTS

| | | | |
|---|---|---|---|
| 674,009 | A | 5/1901 | Lewis |
| 2,475,441 | A | 7/1949 | Abbott |
| 3,067,925 | A | 12/1962 | Gilliam |

(List continued on next page.)

FOREIGN PATENT DOCUMENTS

| | | |
|---|---|---|
| EP | 0 204 863 | 12/1986 |
| EP | 0 276 918 | 8/1988 |
| EP | 0 511 182 | 10/1992 |
| EP | 0 572 965 | 6/1993 |
| EP | 0 671 343 | 3/1995 |
| FR | 2 607 241 | 5/1988 |
| GB | 2 262 885 A | 7/1993 |
| GB | 2 279 232 | 1/1995 |
| WO | WO 93/06430 | 4/1993 |
| WO | WO 97/12195 | 4/1997 |

OTHER PUBLICATIONS

Navy Technical Disclosure Bulletin, vol. 3, No. 2 (Feb. 1978), "Blast Wave Muffling" by Stephen P. Gill, Navy Case 61,187, XP002038474, pp. 29–31.

NTIS Tech Notes, Jul. 1992, Springfield, VA USA, "Blast–Absorbing Bag", XP000308050, p. 496.

Ashley, S., "Safety in the Sky: Designing Bomb–Resistant Baggage Containers", Mechanical Engineer, V114, N6, Jun. '92, pp. 81–86.

P.J. Klass, Hardened Containers Under Development, Aviation Week and Space Technology, vol. 139, No. 21, Nov. 22, 1993, pp. 90–91.

(List continued on next page.)

*Primary Examiner*—Gary E. Elkins
(74) *Attorney, Agent, or Firm*—Virginia Szigeti Andrews; Melanie L. Brown; Roger H. Criss

(57) ABSTRACT

Blast resistant and blast directing container assemblies for receiving explosive articles and preventing or minimizing damage in the event of an explosion. The container assembly includes an opening covered by a band of blast resistant material with at least one slit therethrough in the hoop direction of the band, and optionally, a blast mitigating material located within the container. The container can be collapsible for storage when empty. The container assemblies have utility in aircraft where weight is an important consideration, more particularly as cargo holders or containment devices in the passenger cabin. They are also particularly useful to bomb squad personnel as transport devices for hazardous materials such as gunpowder, high explosives and combinations of high explosives with shrapnel, e.g., grenades and pipe bombs.

16 Claims, 5 Drawing Sheets

U.S. PATENT DOCUMENTS

| | | | | |
|---|---|---|---|---|
| 3,093,259 | A | | 6/1963 | Morrison |
| 3,445,052 | A | | 5/1969 | Lewallen |
| 3,611,512 | A | | 10/1971 | Sholl |
| 3,786,956 | A | | 1/1974 | Tabor |
| 4,027,601 | A | | 6/1977 | Hickerson |
| 4,046,277 | A | | 9/1977 | Morrison |
| 4,055,247 | A | | 10/1977 | Benedick et al. |
| 4,216,803 | A | | 8/1980 | Hall |
| 4,367,260 | A | | 1/1983 | Krause |
| 4,432,285 | A | | 2/1984 | Boyars et al. |
| 4,543,872 | A | | 10/1985 | Graham et al. |
| 4,639,387 | A | | 1/1987 | Epel |
| 4,746,029 | A | | 5/1988 | Tyner, III et al. |
| 4,889,258 | A | | 12/1989 | Yerushalmi |
| 4,916,000 | A | | 4/1990 | Li et al. |
| 4,997,091 | A | * | 3/1991 | McCrea ..... 206/584 |
| 5,011,009 | A | | 4/1991 | Scheurer |
| 5,054,635 | A | | 10/1991 | Kolom |
| 5,133,258 | A | | 7/1992 | Rock et al. |
| 5,170,690 | A | | 12/1992 | Smirlock et al. |
| 5,195,701 | A | | 3/1993 | Willan |
| 5,225,622 | A | | 7/1993 | Gettle et al. |
| 5,238,102 | A | | 8/1993 | Langer |
| 5,249,534 | A | * | 10/1993 | Sacks ..... 109/24 |
| 5,267,665 | A | | 12/1993 | Sania et al. |
| 5,312,182 | A | | 5/1994 | Mlakar et al. |
| 5,333,532 | A | | 8/1994 | Smirlock et al. |
| 5,376,426 | A | | 12/1994 | Harpell et al. |
| 5,395,682 | A | | 3/1995 | Holland et al. |
| 5,545,455 | A | | 8/1996 | Prevorsek et al. |

* cited by examiner

BLAST RESISTANT AND BLAST DIRECTING ASSEMBLIES

RELATED APPLICATIONS

This application is a continuation-in-part of application Ser. No. 08/852754, filed May 7, 1997, which is a CIP of 08/717042, filed Sep. 20, 1996, which is a CIP of 08/533,589, filed Sep. 25, 1995.

BACKGROUND OF THE INVENTION

1. Field of the Invention

The present invention relates to container assemblies. More particularly, this invention relates to various blast resistant and blast directing container assemblies for receiving explosive articles and preventing or minimizing damage in the event of an explosion. These container assemblies have utility as containment and transport devices for hazardous materials such as high explosives or a combination of high explosives plus shrapnel, e.g., grenades combined with pipe bombs. They are particularly useful in aircraft where weight is an important consideration, and more particularly in the cargo holds and passenger cabins of the aircraft. They are also particularly useful to bomb squad personnel in combating terrorist and other threats.

2. The Prior Art

In response to the 1988 terrorist bombing of a Pan American flight over Lockerbie, Scotland, experts in explosives and aircraft-survivability techniques have studied ways to make commercial airliners more resistant to terrorist bombs. One result of these studies has been the development and deployment of new generations of explosive detection devices. As a practical matter, however, there remains a threshold bomb size above which detection is relatively easy but below which an increasing fraction of bombs will go undetected. An undetected bomb likely would find its way into luggage either carried on board (in cabin) by a passenger or stored in an aircraft cargo container. Cargo containers, shaped as cubic boxes with a truncated edge, have typically been made of aluminum, which is lightweight but not explosion-proof As a consequence, there has been tremendous focus in recent years on redesigning containers to be both blast resistant to bombs that are below this threshold size and lightweight.

A good overview on redesigned aircraft cargo containers is found in Ashley, S., *SAFETY IN THE SKY: Designing Bomb-Resistant Baggage Containers,* Mechanical Engineering, v 114, n 6, June 1992, pp 81–86, hereby incorporated by reference. One type of container disclosed by this article is designed to suppress shock waves and contain exploding fragments while safely bleeding off or venting high pressure gases, while another type is designed to guide explosive products overboard by channeling blast forces out of and away from the airplane hull. Several of the new designs utilize composite materials that are both strong and lightweight. In one such design, a hardened luggage container is wrapped in a blanket woven from low density materials such as SPECTRA® fibers, commercially available from AlliedSignal Inc., and lined with a rigid polyurethane foam and perforated aluminum alloy sheet. A sandwich of this material covers four sides of the container in a seamless shell. In this regard, see also U.S. Pat. No. 5,267,665, hereby incorporated by reference.

Access to a container's interior is necessary for loading and unloading and is typically provided by doors. Doors provide a significant weak point for the container during an explosion since a blast from within the container forces a typical door outward. If the door is connected through a hinge and metal pin arrangement, the pins become dangerous projectiles. If the door slides in grooves or channels, the grooves or channels may bend or distort to cause failure of the container. It would thus be desirable to have a container design that eliminates the aforesaid problems with doors for access to the container's interior.

U.S. Pat. No. 5,312,182 discloses hardened cargo containers wherein the door engages by sliding in grooves/tracks with an interlock that ostensibly responds to such an explosive blast by gripping tighter to resist rupture of the device. The parent of this case, pending application Ser. No. 08/533,589, filed Sep. 25, 1995, addresses the door closure problem by utilizing at least three nested, mutually reinforcing, perpendicular bands of, preferably, a blast resistant material. Access to the interior of the container is provided by at least partially removing the two outer bands; this has not been found to be a user-friendly solution due to space constraints of the container on an aircraft or excessive handling of the container.

Other blast resistant and/or blast directing containers are described in European Patent Publication 0 572 965 A1 and in U.S. Pat. Nos. 5,376,426; 5,249,534; and 5,170,690. All of these publications are hereby incorporated by reference.

Containers for storing and/or transporting explosives such as bombs, or suspected explosives, are also known. See, for example, U.S. Pat. Nos. 5,225,622; 4,889,258; 4,432,285; 4,055,247; 4,027,601; and 3,786,956, all hereby incorporated by reference. These containers are typically made of a high strength outer housing having a fixed shape and containing a structure for supporting the explosive out of contact with the housing. High strength materials taught for forming the outer housing include metal, such as stainless steel or steel plate, and ballistic fiberglass. Supporting structures taught include vermiculite in a binder, foamed plastic (such as Styrofoam), foam rubber, and cardboard. The containers generally are heavy and have a bulky, fixed shape or construction.

The environment in which a container is to be used may have weight and space constraints, for example, the passenger cabin or cargo hold of an aircraft. Such constraints make desirable a collapsible container that folds into a compact shape for storage when not in use.

The present invention, which was developed to overcome the deficiencies of the prior art, provides blast resistant and blast directing containers and container assemblies, some of which are collapsible.

BRIEF DESCRIPTION OF THE INVENTION

This invention is a blast resistant container assembly for receiving an explosive. The container assembly comprises a container having a band of blast resistant material covering an access opening. The band has at least one slit therethrough which can be aligned with a portion of the access opening for placing a suspected explosive inside the container. Blast mitigating material is optionally located within the container.

In another embodiment the blast resistant container assembly comprises at least three bands, one of which preferably comprises a blast resistant material. A first inner band is nested within a second band which is nested within a third band, with all bands being oriented relative to one another to substantially enclose a volume and to form a container wall having a thickness substantially equivalent to the sum of the thicknesses of at least two of the bands. Blast mitigating material is optionally located within the inner band.

In a particularly preferred embodiment the blast resistant container assembly comprises at least three seamless bands of a blast resistant material and an aqueous foam. One or more of the bands preferably is collapsible. The blast resistant material comprises high strength fibers having a tenacity of at least about 10 g/d and a tensile modulus of at least about 200 g/d. The bands are nested one within the other when assembled with their longitudinal axes at right angles to one another to substantially enclose a volume and to form a container wall having a thickness substantially equivalent to the sum of the thicknesses of at least two of the bands. The inner band preferably includes a foldable flap forming a lip on each side thereof and is stabilized to prevent twisting. The inner band can be stabilized by consolidation if it comprises a composite material or by affixing rigid plates or other support structure thereto if not susceptible to consolidation. The aqueous foam located within the inner band preferably has a density in the range of from about 0.01 to about 0.10 g/cm$^3$, more preferably in the range of from about 0.03 to about 0.08 g/cm$^3$, and preferably is inhibited from contact with the suspected explosive if used for bomb removal. This embodiment is particularly useful as an aircraft in-cabin emergency containment system or as a bomb squad container for transport and/or removal of bombs.

In an alternate embodiment, the present invention is a blast resistant container assembly for receiving an explosive wherein the container assembly comprises a container having an access opening; blast mitigating material located within the container; and at least one band of a blast resistant material. The band slides over the container in a first direction to encircle the container and at least partially cover the access opening, and in a second direction to at least partially expose the access opening. The band or bands together preferably cover substantially all of the surface area of the access opening. This embodiment is particularly useful for the containment and removal of explosives found by detection or screening devices, for example, in airports.

The three band box design of the preferred container assembly of this invention has several advantages over containers of the prior art. It eliminates the need for an entry door since access can be achieved through a slit in either the middle or innermost band. This eliminates one of the weak points of the prior art containers: door and panel hinges with steel rods are no longer necessary and neither are door-channel interlock systems. Other modifications permit easy access to the container's interior for loading and unloading in spite of limited exterior space constraints. The box is not impervious to explosive's gas and allows controlled release of the gas through the slit or slits, which contributes to the design function. The box production is technology inexpensive and simple. The bands of the box can be made rigid or flexible as desired. If the bands of the box are made with flexible edges and rigid faces, then they can be collapsed for more efficient storage and transported as a set of three or more essentially flat parts (bands) for subsequent assembly and use with the blast mitigating material.

Blast mitigating materials can absorb heat energy from the blast by an increase in temperature, phase transition, e.g., vaporization of water. They may collapse and absorb energy by crushing and/or visco-elastic effects. Condensable gases (in foams) may condense under elevated pressure, thereby liberating heat of condensation to the aqueous phase. Condensable gases will cause a decrease in shock wave velocity and through condensation transmit heat energy. Kinetic energy can be imparted to all of these materials.

The use of aqueous foam with condensable gas as a foaming agent significantly lengthens the time of venting and reduces the hazard. As such, it is a preferred blast mitigating materials. In bomb squad containers, however, where it is important to preserve evidence, the foam should be kept out of contact with the suspected bomb. A bladder is an efficient way to achieve this.

BRIEF DESCRIPTION OF THE DRAWINGS

The invention will be more fully understood and further advantages will become apparent when reference is made to the following drawing figures and the accompanying description of the preferred embodiments wherein:

FIGS. 1A through 1G are views wherein

FIG. 1A is a three dimensional view of band 11 which forms part of container assembly 10 of FIG. 1F;

FIG. 1B is a three dimensional view of band 12 which forms part of container assembly 10 of FIG. 1F;

FIG. 1C is a three dimensional view of band 13 which, when filled with blast mitigating material 14 and assembled with bands 11 and 12, constitute container assembly 10 of FIG. 1F;

FIG. 1D is a three dimensional partial assembly view which together with FIG. 1E illustrates the assembly sequence for container assembly 10;

FIG. 1E is a three dimensional partial assembly view which together with FIG. 1D illustrates the assembly sequence for container assembly 10;

FIG. 1F is a three dimensional assembly view of container assembly 10;

FIG. 1G is a three dimensional view of an optional support structure 17 for inclusion in the assembly of container assembly 10;

FIGS. 2A through 2C also represent a container assembly wherein

FIG. 2A is a three dimensional view of alternate band 11' cut at corners 16 to create portions which when folded will create lips 18;

FIG. 2B is a three dimensional view of alternate band 11' with lips 18;

FIG. 2C is a three dimensional partial assembly view that illustrates the assembly sequence for container assembly 10';

FIGS. 4A through 4E are views wherein

FIG. 4A is a three dimensional view of alternate inner band 31 with lips 38;

FIG. 4B is a three dimensional view of alternate middle band 32;

FIG. 4C is a three dimensional assembly view of bands 31 and 32;

FIG. 4D is a three dimensional view of outer band 33,

FIG. 4E is a three dimensional assembly view of container 30;

FIGS. 5A through 5C are views wherein

FIG. 5A is a three dimensional view of inner band 41 with slit 44;

FIG. 5B is a three dimensional view of middle band 42 with slit 45; and FIG. 5C is a three dimensional assembly view of container 40 wherein slits 44 and 45 are at right angles to one another.

DETAILED DESCRIPTION OF THE INVENTION

Figure 1A:
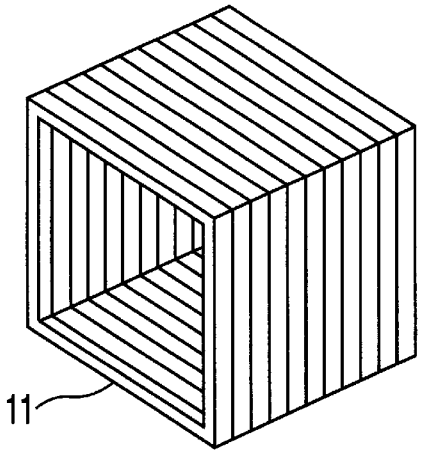

The preferred invention will be better understood by those of skill in the art with reference to the above figures. The preferred embodiments of this invention illustrated in the figures are not intended to be exhaustive or to limit the invention to the precise form disclosed. It is chosen to describe or to best explain the principles of the invention and its application and practical use to thereby enable others skilled in the art to best utilize the invention. In particular, the bands of blast resistant material are shown in the accompanying drawings with parallel lines representing substantially continuous fibers/filaments in the hoop direction of the bands, i.e., as unidirectional fibrous bands. This representation is for ease in understanding the invention—while it constitutes one fabric contemplated for use in the present invention, it is not the exclusive fabric.

Initial discussion of the drawing figures will be directed to design considerations followed by a discussion of appropriate materials and how they affect blast resistance and/or blast directing capabilities of the structures.

Figure 1B:
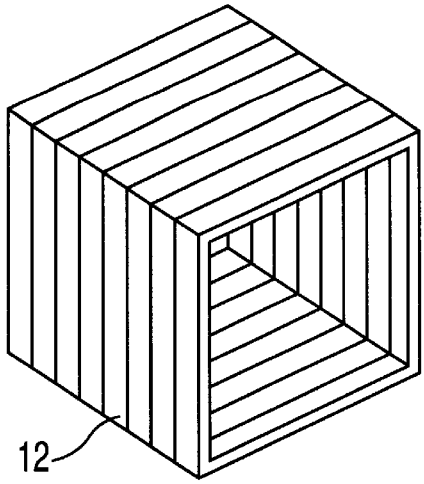
Figure 1D:
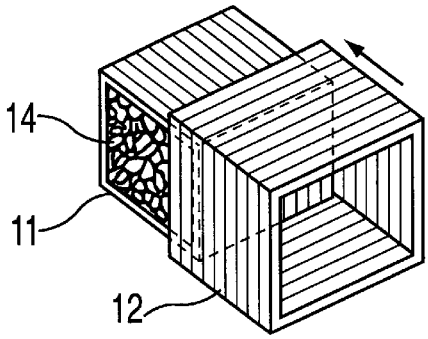
Figure 1C:
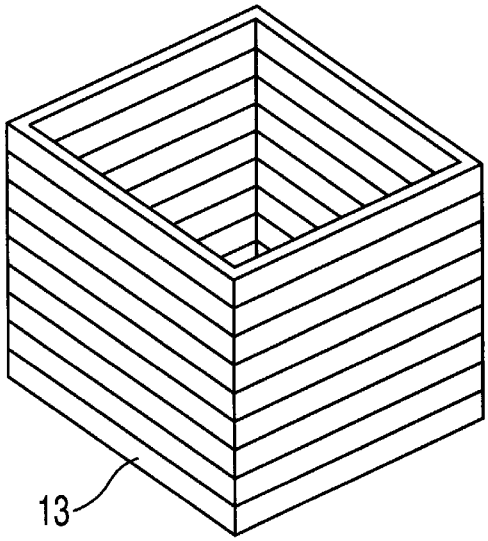
Figure 1E:
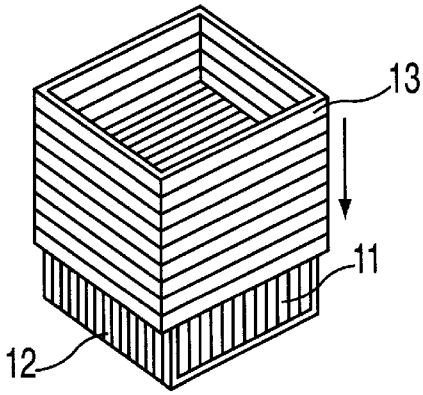
Figure 1F:
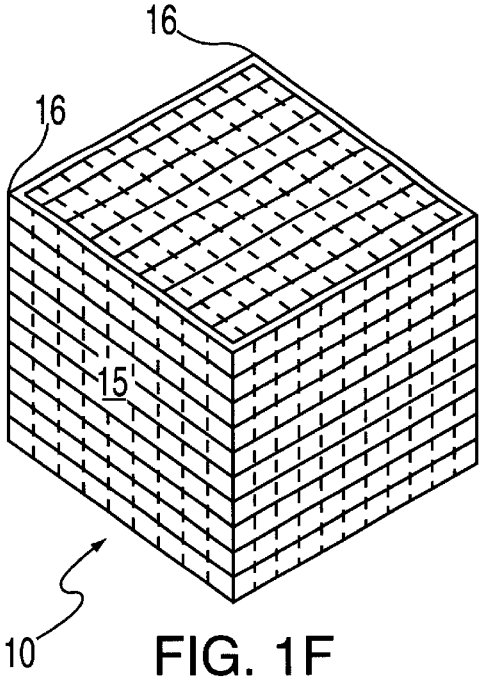
Figure 1G:
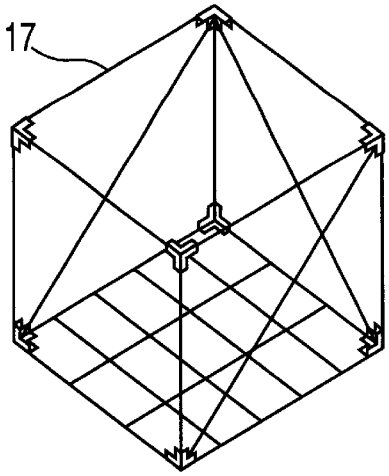

Referring to FIG. 1F, the numeral 10 indicates a blast resistant container assembly. The construction of container assembly 10 is critical to the advantages of this invention. The container comprises a set of at least three nested and mutually reinforcing four-sided continuous bands of material 11, 12, and 13 assembled into a cube. See FIGS. 1A, 1B, and 1C. By "band" is meant a thin, flat, volume-encircling strip. The cross-section of the encircled volume may vary, although polygonal is preferred to circular, with rectangular being more preferred and square being most preferred, as depicted. With reference to FIGS. 1D and 1E, a first inner band 11 is optionally filled with blast mitigating material 14 (depicted as an aqueous foam) and then nested within a slightly larger second band 12 which is nested within a slightly larger third band 13, all bands with their respective longitudinal axes perpendicular to one another. In this fashion, each of the six panels forming the faces of the cubic container will have a thickness substantially equivalent to the sum of the thicknesses of at least two of the bands 11, 12 and 13, where they overlap, and every edge 15 of the container is covered by at least one band of material, 11, 12, or 13. Stated differently, after the load (explosive or luggage) is placed in the first band 11, blast mitigating material 14 is placed or dispersed around the load within the first band 11. The second structurally similar band 12 of slightly larger dimensions is placed over the first so that its longitudinal axis is perpendicular to that of first band 11 (see FIG. 1D). The third, similar yet larger, band 13 is slid over the second band 12, so that its longitudinal axis is perpendicular to the axes of both bands 11 and 12 (see FIG. 1E). The third band 13 completes the preferred blast resistant container assembly 10. The fit between bands 11, 12 and 13 is not intended to be a gastight seal, but is a close fit to permit gas to vent gradually, in the event of an explosion, from the corners 16 of the cubic container. It is preferred that the bands slide on one another, and therefore the frictional characteristics of their surfaces may need to be modified, as will be discussed in more detail later. Container assembly 10 does not have a separate entry door and thus avoids all of the limitations presented by the same in the prior art. FIG. 1G depicts a weight/load bearing frame 17 which may optionally be nested within container assembly 10 in the event that container assembly 10 is insufficiently rigid for bearing the items to be loaded therein. Inner band 1 is slipped over the frame initially, and then assembly proceeds as earlier discussed. Frame 17 may be made from metal or structural composite rods designed in a way to optimize the load bearing capacity of the structure and to minimize container weight.

Figure 2A:
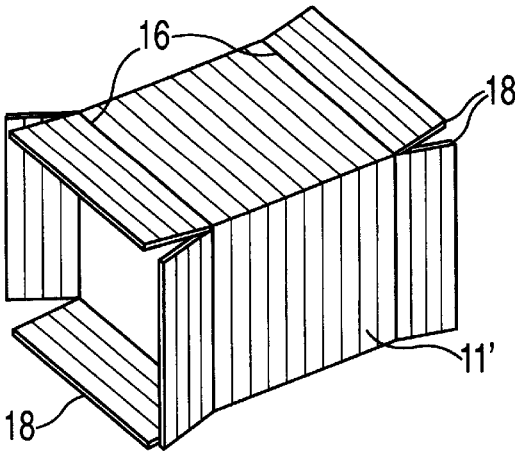
Figure 2B:
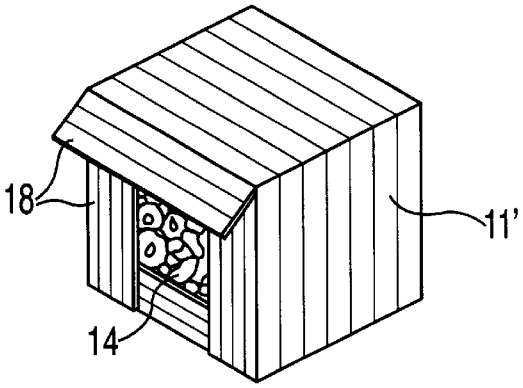
Figure 2C:
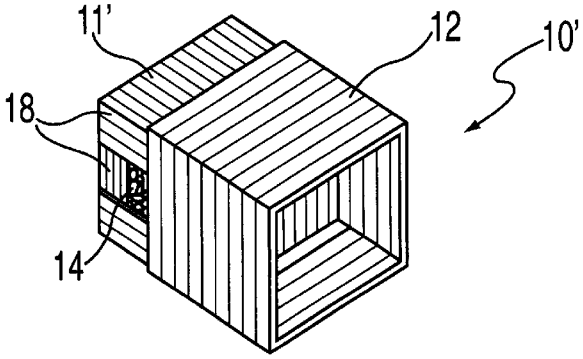

With reference to FIGS. 2A, 2B AND 2C, which depict another variation on the basic design, inner band 11 is replaced by inner band 11' which has lips 18 formed on both sides thereof prior to being filled with blast mitigating material 14 and subsequent assembly with the other bands 12 and 13. Band 11' can be made wider than needed, cut at each corner 16, and folded to create lips 18 on each side (see FIGS. 2A and 2B). Lip 18 is a projecting edge or small flap which is substantially perpendicular to the plane of band 11' in use—the next outermost band (in this instance band 12) will hold flap 18 in this relationship to band 11'. The presence of lips 18 during an explosion of the container serves to limit the rate at which hot gases escape from the container after an explosion; this serves to prevent damage to nearby people and property, as well as to decrease the danger of the container catching fire. Any inside band can be formed with lips; however, best results are obtained with the lips 18 on the innermost band 11'. If lips are present on both inner bands, then the edges will have two band equivalents covering them.

Many differing container shapes are contemplated by the present invention. For instance, the container assembly can enclose a non-cubic rectangular prism due to the differing rectangular cross-sections of its three bands. It should also be appreciated that substantially more than three bands can readily be utilized in the present invention, even with the basic cube (or rectangular prism) design of the container. Similarly, a basic two band construction can be utilized as well. It is preferred that the outermost band comprises a single continuous band. Furthermore, a large number of coaxial bands can also be coaxially nested one within the other to substitute for any one band in the basic container concept of the invention; the number of bands utilized as an equivalent may depend upon the desired rigidity of the equivalent. It is possible to have several flexible bands which, when nested coaxially, become rigid.

The container assembly can be a container of the prior art with an access opening on one or more sides thereof, or it can be a container with two bands of the three-band concept already discussed and having an access opening on one or more sides thereof The shape of the band's inner cross-section should conform to the portion of the container that it encircles. A polygonal cross-section is preferred with rectangular being more preferred and square being most preferred. Closure via this design can be achieved without hinges or door channels.

The present invention provides easier access to the interior of the container. The bands of the FIGS. 1 and 2 embodiments can be modified by incorporating at least one slit therethrough for access to the interior of the container. A slit is an opening in a band that is parallel to and always in the hoop (encircling) direction of the band. It is most preferred that at least 50 weight percent of any fiber contained in the band be continuous length fibers in the hoop direction parallel to the slit or slits. The slits are incorporated into the bands in such a way that if the band material contains fibers, very few of the fibers in the hoop direction are cut. Consequently most of the strength of the bands is retained. Such slits may be used for a variety of purposes, but the most important for purposes of this invention are the insertion and removal of suspected bomb material. The slit can also be used to insert a lens and/or lights for observation, as well as the insertion or removal of solids, liquids or gases. Movement of the container can also be controlled by appropriate location of a slit or slits due to the venting of gases during the explosive event.

The width of a slit should be restricted in order to restrict the fraction of the fibers in the hoop direction which are cut. The slit width for a band should be less than 20% of the band width, preferably less than 10% of band width, more preferably less than 5% of the band width, and most preferably less than 2% of the band width. See FIG. 3 wherein band 20 is depicted as a continuous, seamless band of fiber-reinforced composite material with two slits 21 and 21' in one side thereof, the length dimension of which is parallel to the hoop direction. Slit 21 is the preferred narrow width slit while slit 21' represents the largest practical slit of about 20% of the width of the face. As a practical matter, the largest acceptable slit width is about 3 inches; about 0.125 inch is preferred, and represents the width left by cutting the band material with a heated knife.

For use in three band containers slit length should be less than 75% (or up to 3 sides) of the hoop perimeter, preferably less than 50% (or up to 2 sides), more preferably less than 35% and most preferably less than 25%, i.e., confined to one side. Zippers and hook and loop style fasteners may optionally be used to close slits for operational simplicity. In cases where a single band is used alone slit length would be more restricted. In this case slit length should be less than 50% of perimeter, preferably less than 35%, more preferably less than 25% and most preferably less than 15%.

The slit band may be used with any container having an opening for access to the container interior. Optionally, the slit can be rotated away from the opening so that the opening is covered by a portion of the unslit band. A wedge can be used to cause the band to more tightly fit the container.

Figure 5A:
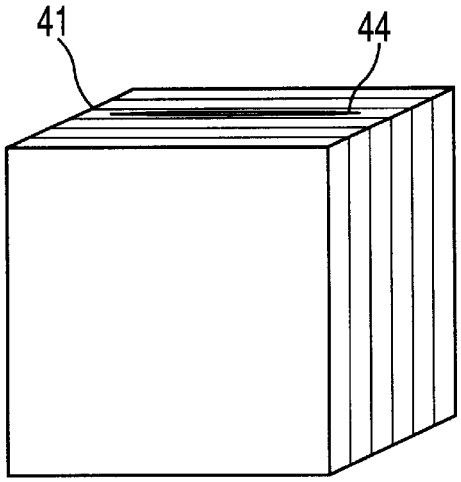
Figure 5B:
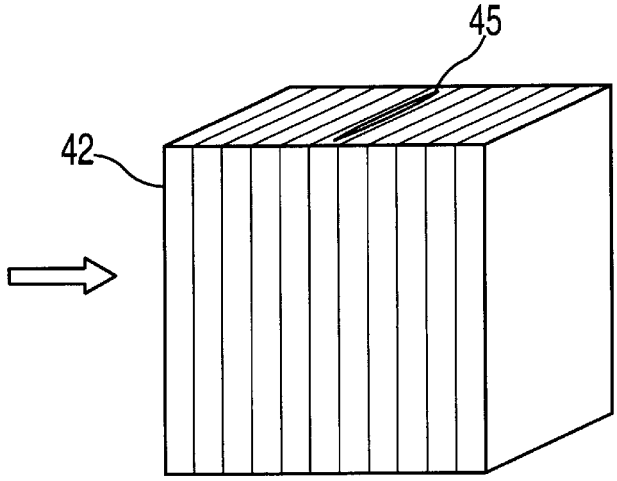
Figure 5C:
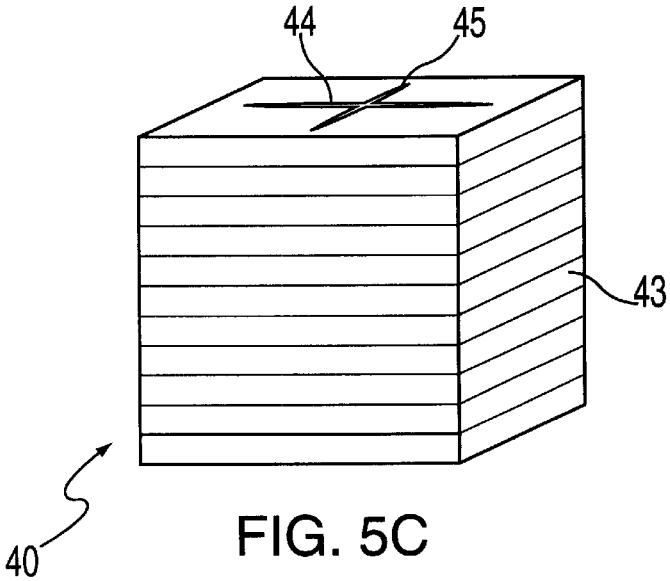

With reference to FIGS. 4 and 5, two other embodiments are shown wherein there are slits on more than one band of the assembly. FIG. 4E depicts container assembly 30 which comprises inner band 31 (FIG. 4A) with lips 38 and slit 34 therethrough in the hoop direction, middle band 32 (FIG. 4B) with slit 35 therethrough in the hoop direction, and outer band 33 which has no slits. Access to the interior of this container may be had through slit 35 in the top, or through slit 34 in the side of the partially assembled container. FIG. 5C depicts assembly 40 wherein inner band 41 (FIG. 5A) and middle band 42 (FIG. 5B) are oriented so that their respective slits, 44 and 45, are at right angles relative to one another when assembled. Outer band 43 does not cover these slits 44 and 45. An explosion within this container would likely vent through the slits in the top of this container.

The extent to which the slit band can open to allow the insertion and removal of articles will depend upon the following factors: length of the slit, relative to other band dimensions; fiber properties and matrix properties/relative proportions of fiber and matrix; construction details, e.g., fabric weave, belt weave; properties of band between slit band and inner cavity; rigidity and arrangement of blast mitigating materials within inner cavity; and the areal density of the band.

When three four-sided bands (all of equal areal density) are assembled to create a cube, the areal density at the faces is twice that of the individual bands, but the areal density at the edges is that of a single band. Consequently, modifications to the bands are desirable for certain applications. Flaps (lips) around the inner band raise the areal density of the four adjacent edges to that of the faces, i.e., twice that of the individual bands. Additional reinforcement may be placed at the other edges, as desired.

One of the advantages of incorporating a slit in either the inner or middle band is the ability to permanently assemble or preassemble these two bands; this permits the faster insertion of the suspect package followed by putting the outer band in place. Substantial protection is achieved as soon as the package is placed in the inner/middle band assembly, and the additional time required to place the outer band in position can be quite short. To enhance efficiency, the outer band may be positioned so that the combined inner and middle band assembly can be pushed into it. The operation becomes simple and quick, with a minimum of handling or jostling of the suspect package.

The resistance to distortion of the bands can be varied monatonically from quite flexible to highly rigid. There are four possible combinations of inner and middle bands, each combination having particular advantages and disadvantages. The combinations are: flexible inner and middle bands; flexible inner band with a rigid middle band; rigid inner band with a flexible middle band; and rigid inner and middle bands.

The combination of flexible inner and middles bands permits this assembly to be collapsible, and the slit may be placed on either band to allow excellent access to the interior of the container. Some interior struts, optionally put in position after insertion of the suspect package, are desirable to maintain the desired shape.

The combination of flexible inner band with a rigid middle band permits extensive distortion of the inner band while the overall shape and rigidity of the middle band is maintained. The attachments of the inner band may be via elastomeric strapping, thread, clips, etc. in order to maximize opening size. The middle band can be modified in order to provide a more structurally stable structure by placing rigid lips around both edges of the band or by converting the band to a five sided container with lips around the sixth side. In these configurations the slit is preferably placed on the inner band. This assembly is not collapsible.

The combination of rigid inner band with a flexible middle band is one where the slit is preferably on the middle band. The access opening is smaller than with either of the previously described configurations. A longer, or looser, middle band permits a longer access opening. One or more folds may be incorporated into the middle band, kept in position with elastic thread or fasteners, in order to significantly increase the access opening size. This assembly is not collapsible.

The combination of rigid inner and middle bands permits insertion of packages that are narrow in width due to the inflexibility of the slit; the slit, however can be on either band. If the walls are modified to have creases, the assembly allows the insertion of substantially bigger objects and is collapsible. Crease lines can be made by selectively leaving lines of the band material unconsolidated, similar to forming the edges, or fold lines, for collapsible bands.

Any of the foregoing combinations may be combined with a third, outer band which can be either flexible or rigid. The combination of three flexible bands can lead to a totally collapsible container which can be easily stowed. A rigid outer band combined with a flexible inner band and rigid middle band provides an assembly having easy access, coupled with rapid closure. In this latter combination, the assembled inner and middle bands, preferably attached, can slide into the outer band using ancillary fixtures which are normally used to aid in the opening and closing of drawers. The entire assembly may be part of a desk or desk-like structure.

Blast mitigating materials are detailed below. With this invention, it is desirable for blast mitigating material to be flexible in certain locations in order to achieve maximum access to the containers, particularly on the slit-containing face.

It is also desirable that the materials of construction of containers be relatively X-ray transparent in order to be able to X-ray suspicious packages while inside the blast resistant container. Extended chain polyethylene fibers, aramid fibers, and organic matrices are relatively X-ray transparent. In addition these materials will not contribute to shrapnel from an explosion. These features illustrate the advantages of our structures over competing metal structures.

In the various embodiments depicted, a rigid inner liner or band can be constructed using one or more of the techniques and/or material to follow. The inner liner/band may be rotationally molded using polyethylene, cross-linkable polyethylene, nylon 6, or nylon 6,6 powders. Technology described in *Plastics World,* p.60, July, 1995, hereby incorporated by reference, can also be used. Tubes, rods and connectors may be used, preferably formed from thermoplastic or thermoset resins, optionally fiber reinforced, or low density metals such as aluminum. Sandwich constructions consisting of honeycomb, balsa wood or foam core with rigid facings may be used. The honeycomb may be constructed from aluminum, cellulose products, or aramide polymer. Weight can be minimized by using construction techniques well known in the aerospace industry. (Carbon fiber reinforced epoxy composites may be used.) A rigid inner shell/band can be constructed from wood using techniques well known to the carpentry trades. (Flame retardant paints may usefully be used.) The rigid inner liner/band may serve as a mandrel onto which the bands are wound and can form part of the final blast container. Alternatively the inner liner can be inserted into the inner band after the band has been constructed.

As used herein with respect to bands, "rigid" means that a band is inflexible across the face or faces thereof If the band comprises a plurality of faces and edges, then it may be substantially inflexible across the faces but retain its flexibility at the edges and still be considered "rigid." Such a band is also considered "collapsible" since its flexible edges act as pin-less hinges connecting the substantially inflexible faces, and the band can be essentially flattened by folding at least two of its edges. With respect to the faces, flexibility is determined as follows. A length of the material is clamped horizontally along one side on a flat support surface with an unsupported overhang portion of length "L". The vertical distance "D" that the unclamped side of the overhang portion drops below the flat support surface is measured. The ratio D/L gives a measure of drapability. When the ratio approaches 1, the structure/face is highly flexible, and when the ratio approaches 0, it is very rigid or inflexible. Structures are considered rigid when D/L is less than about 0.2, more preferably less than about 0.1.

The structural designs of the present invention, especially the three band cube design, enhance the blast containment capability of the container. Blast containment capability is also enhanced with increased areal density of the container. The "areal density" is the weight of a structure per unit area of the structure in $kg/m^2$, as discussed in more detail in conjunction with the examples which follow below. The preferred blast resistant materials utilized in forming the containers and bands of the present invention are oriented films, fibrous layers, and/or a combination thereof A resin matrix may optionally be used with the fibrous layers, and a film (oriented or not) may comprise the resin matrix.

Uniaxially or biaxially oriented films acceptable for use as the blast resistant material can be single layer, bilayer, or multilayer films selected from the group consisting of homopolymers and copolymers of thermoplastic polyolefins, thermoplastic elastomers, crosslinked thermoplastics, crosslinked elastomers, polyesters, polyamides, fluorocarbons, urethanes, epoxies, polyvinylidene chloride, polyvinyl chloride, and blends thereof. Films of choice are high density polyethylene, polypropylene, and polyethylene/elastomeric blends. Film thickness preferably ranges from about 0.2 to 40 mils, more preferably from about 0.5 to 20 mils, most preferably from about 1 to 15 mils.

For purposes of this invention, a fibrous layer comprises at least one network of fibers either alone or with a matrix. Fiber denotes an elongated body, the length dimension of which is much greater than the transverse dimensions of width and thickness. Accordingly, the term fiber includes monofilament, multifilament, ribbon, strip, staple and other forms of chopped, cut or discontinuous fiber and the like having regular or irregular cross-sections. The term fiber includes a plurality of any one or combination of the above.

The cross-sections of filaments for use in this invention may vary widely. They may be circular, flat or oblong in cross-section. They also may be of irregular or regular multi-lobal cross-section having one or more regular or irregular lobes projecting from the linear or longitudinal axis of the fibers. It is particularly preferred that the filaments be of substantially circular, flat or oblong cross-section, most preferably the former.

By network is meant a plurality of fibers arranged into a predetermined configuration or a plurality of fibers grouped together to form a twisted or untwisted yarn, which yarns are arranged into a predetermined configuration. For example, the fibers or yarn may be formed as a felt or other nonwoven, knitted or woven (plain, basket, satin and crow feet weaves, etc.) into a network, or formed into a network by any conventional techniques. According to a particularly preferred network configuration, the fibers are unidirectionally aligned so that they are substantially parallel to each other along a common fiber direction. Continuous length fibers are most preferred although fibers that are oriented and have a length of from about 3 to 12 inches (about 7.6 to about 30.4 centimeters) are also acceptable and are deemed "substantially continuous" for purposes of this invention.

It is preferred that within a fibrous layer at least about 50 weight percent of the fibers, more preferably at least about 75 weight percent, be substantially continuous lengths of fiber that encircle the volume enclosed by the container. By encircle the volume is meant in the band or hoop direction, i.e., substantially parallel to or in the direction of the band, as band has been previously defined and shown. By substantially parallel to or in the direction of the band is meant within ±10°. It is also preferred that the bands of the present invention be substantially seamless. By substantially seamless is meant that the band is seamless across each edge joining adjacent faces for more than at least one full wrap of the fibrous layer and also that at any given point on the band there is at least one wrap/layer that is seamless. With this definition, a band with five faces wherein the first and fifth faces are not joined but overlap would be considered substantially seamless, even though the first and fifth faces are not joined to one another. Thus, each face of a band is preferably connected to another face at at least one common edge with a fibrous material that functions as a hinge therebetween; the preferred fibrous material comprises substantially continuous, parallel lengths of fiber perpendicular to the edge.

The continuous bands can be fabricated using a number of procedures. In one preferred embodiment, the bands, especially those without resin matrix, are formed by winding fabric around a mandrel and securing the shape by suitable securing means, e.g., heat and/or pressure bonding, heat shrinking, adhesives, staples, sewing and other securing means known to those of skill in the art. Sewing can be either spot sewing, line sewing or sewing with intersecting sets of parallel lines. Stitches are typically utilized in sewing, but no specific stitching type or method constitutes a preferred securing means for use in this invention. Fiber used to form stitches can also vary widely. Useful fiber may have a relatively low modulus or a relatively high modulus, and may have a relatively low tenacity or a relatively high tenacity. Fiber for use in the stitches preferably has a tenacity equal to or greater than about 2 g/d and a modulus equal to or greater than about 20 g/d. All tensile properties are evaluated by pulling a 10 in (25.4 cm.) fiber length clamped between barrel clamps at 10 in/min (25.4 cm/min) on an Instron Tensile Tester. In cases where it is desirable to make the band somewhat more rigid, pockets can be sewn in the fabric into which rigid plates may be inserted, or the plates themselves can be sewn into the band between wraps of material. This is another "collapsible" embodiment of rigid bands, i.e., the faces are rigid due to the presence of the rigid plates, but the edges are flexible due to the flexible fabric forming the bands or can be bent by, e.g., the weight of the rigid face portion. An advantage to the collapsible embodiments of the present invention is that the apparatus can be transported flat and set up immediately prior to use. Another way to make wraps of fabric selectively rigid within a band is by way of stitch patterns, e.g., parallel rows of stitches can be used across the face portions of the band to make them rigid while leaving the joints/edges unsewn to create another "collapsible" rigid band.

The type of fibers used in the blast resistant material may vary widely and can be inorganic or organic fibers. Preferred fibers for use in the practice of this invention, especially for the substantially continuous lengths, are those having a tenacity equal to or greater than about 10 grams/denier (g/d) and a tensile modulus equal to or greater than about 200 g/d (as measured by an Instron Tensile Testing machine). Particularly preferred fibers are those having a tenacity equal to or greater than about 20 g/d and a tensile modulus equal to or greater than about 500 g/d. Most preferred are those embodiments in which the tenacity of the fibers is equal to or greater than about 25 g/d and the tensile modulus is equal to or greater than about 1000 g/d. In the practice of this invention, the fibers of choice have a tenacity equal to or greater than about 30 g/d and a tensile modulus equal to or greater than about 1200 g/d.

High performance fibers can be incorporated into bands together and/or in conjunction with other fibers which may be inorganic, organic or metallic. Preferably the high performance fiber is the continuous (warp) fiber and the other fiber is the fill fiber. Optionally the other fiber can be incorporated in both warp and fill. Such fabrics are designated hybrid fabrics. Hybrid fabrics can be used to construct one or more bands of the container. Preferably, hybrid fabrics would be used to construct part or all of the outer band. Bands can also be created by simultaneously or serially wrapping one or more fabrics made with conventional fibers with one or more fabrics made from high performance fibers.

The denier of the fiber may vary widely. In general, fiber denier is equal to or less than about 8,000. In the preferred embodiments of the invention, fiber denier is from about 10 to about 4000, and in the more preferred embodiments of the invention, fiber denier is from about 10 to about 2000. In the most preferred embodiments of the invention, fiber denier is from about 10 to about 1500. Fabrics made with coarser (higher) denier fibers will allow more venting of gases, which may be desirable in some cases.

Useful inorganic fibers include S-glass fibers, E-glass fibers, carbon fibers, boron fibers, alumina fibers, zirconia-silica fibers, alumina-silica fibers and the like.

Illustrative of useful inorganic filaments for use in the present invention are glass fibers such as fibers formed from quartz, magnesia alumuninosilicate, non-alkaline aluminoborosilicate, soda borosilicate, soda silicate, soda lime-aluminosilicate, lead silicate, non-alkaline lead boroalumina, non-alkaline barium boroalumina, non-alkaline zinc boroalumina, non-alkaline iron aluminosilicate, cadmium borate, alumina fibers which include "saffil" fiber in eta, delta, and theta phase form, asbestos, boron, silicone carbide, graphite and carbon such as those derived from the carbonization of saran, polyaramide (Nomex), nylon, polybenzimidazole, polyoxadiazole, polyphenylene, PPR, petroleum and coal pitches (isotropic), mesophase pitch, cellulose and polyacrylonitrile, ceramic fibers, metal fibers as for example steel, aluminum metal alloys, and the like.

Illustrative of useful organic filaments are those composed of polyesters, polyolefins, polyetheramides, fluoropolymers, polyethers, celluloses, phenolics, polyesteramides, polyurethanes, epoxies, aminoplastics, silicones, polysulfones, polyetherketones, polyetheretherketones, polyesterimides, polyphenylene sulfides, polyether acryl ketones, poly(amideimides), and polyimides. Illustrative of other useful organic filaments are those composed of aramids (aromatic polyamides), such as poly(m-xylylene adipamide), poly(p-xylylene sebacamide), poly(2,2,2-trimethyl-hexamethylene terephthalamide), poly (piperazine sebacamide), poly(metaphenylene isophthalamide) and poly(p-phenylene terephthalamide); aliphatic and cycloaliphatic polyamides, such as the copolyamide of 30% hexamethylene diammonium isophthalate and 70% hexamethylene diammonium adipate, the copolyamide of up to 30% bis-(-amidocyclohexyl) methylene, terephthalic acid and caprolactam, polyhexamethylene adipamide (nylon 66), poly(butyrolactam) (nylon 4), poly(9-aminonoanoic acid) (nylon 9), poly (enantholactam) (nylon 7), poly(capryllactam) (nylon 8), polycaprolactam (nylon 6), poly(p-phenylene terephthalamide), polyhexamethylene sebacamide (nylon 6,10), polyaminoundecanamide (nylon 11), polydodecanolactam (nylon 12), polyhexamethylene isophthalamide, polyhexamethylene terephthalamide, polycaproamide, poly (nonamethylene azelamide (nylon 9,9), poly(decamethylene azelamide) (nylon 10,9), poly(decamethylene sebacamide) (nylon 10,10), poly[bis-(4-aminocyclohexyl)methane 1,10-decanedicarboxamide] (Qiana) (trans), or combinations thereof, and aliphatic, cycloaliphatic and aromatic polyesters such as poly(1,4-cyclohexylidene dimethyl eneterephthalate) cis and trans, poly(ethylene-1,5-naphthalate), poly(ethylene-2,6-naphthalate), poly(1,4-cyclohexane dimethylene terephthalate) (trans), poly (decamethylene terephthalate), poly(ethylene terephthalate), poly(ethylene isophthalate), poly(ethylene oxybenzoate), poly(para-hydroxy benzoate), poly(dimethylpropiolactone), poly(decamethylene adipate), poly(ethylene succinate), poly (ethylene azelate), poly(decamethylene sabacate), poly(a,a-dimethylpropiolactone), and the like.

Also illustrative of useful organic filaments are those of polybenzoxazoles and polybenzothiazoles, as detailed in *The Handbook of Fiber Science and Technology: Volume II. High Technology Fibers, Part D,* edited by Menachem Lewin.

Also illustrative of useful organic filaments are those of liquid crystalline polymers such as lyotropic liquid crystalline polymers which include polypeptides such as poly-α-benzyl L-glutamate and the like; aromatic polyamides such as poly(1,4-benzamide), poly(chloro-1-4-phenylene terephthalamide), poly(1,4-phenylene fumaramide), poly (chloro-1,4-phenylene fumaramide), poly(4,4'-benzanilide trans, trans-muconamide), poly(1,4-phenylene mesaconamide), poly(1,4-phenylene) (trans-1,4-cyclohexylene amide), poly(chloro-1,4-phenylene) (trans-1,4-cyclohexylene amide), poly(1,4-phenylene 1,4-dimethyl-trans-1,4-cyclohexylene amide), poly(1,4-phenylene 2,5-pyridine amide), poly(chloro-1,4-phenylene 2,5-pyridine amide), poly(3,3'-dimethyl-4,4'-biphenylene 2,5 pyridine amide), poly(1,4-phenylene 4,4'-stilbene amide), poly (chloro-1,4-phenylene 4,4'-stilbene amide), poly(1,4-phenylene 4,4'-azobenzene amide), poly(4,4'-azobenzene 4,4'-azobenzene amide), poly(1,4-phenylene 4,4'-azoxybenzene amide), poly(4,4'-azobenzene 4,4'-azoxybenzene amide), poly(1,4-cyclohexylene 4,4'-azobenzene amide), poly(4,4'-azobenzene terephthal amide), poly(3,8-phenanthridinone terephthal amide), poly (4,4'-biphenylene terephthal amide), poly(4,4'-biphenylene 4,4'-bibenzo amide), poly(1,4-phenylene 4,4'-bibenzo amide), poly(1,4-phenylene 4,4'-terephenylene amide), poly (1,4-phenylene 2,6-naphthal amide), poly(1,5-naphthalene terephthal amide), poly(3,3'-dimethyl-4,4-biphenylene terephthal amide), poly(3,3'-dimethoxy-4,4'-biphenylene terephthal amide), poly(3,3'-dimethoxy-4,4-biphenylene 4,4'-bibenzo amide) and the like; polyoxamides such as those derived from 2,2'-dimethyl-4,4'-diamino biphenyl and chloro-1,4-phenylene diamine; polyhydrazides such as poly chloroterephthalic hydrazide, 2,5-pyridine dicarboxylic acid hydrazide) poly(terephthalic hydrazide), poly(terephthalic-chloroterephthalic hydrazide) and the like; poly(amide-hydrazides) such as poly(terephthaloyl 1,4 amino-benzhydrazide) and those prepared from 4-amino-benzhydrazide, oxalic dihydrazide, terephthalic dihydrazide and para-aromatic diacid chlorides; polyesters such as those of the compositions include poly(oxy-trans-1,4-cyclohexyleneoxycarbonyl-trans-1,4-cyclohexylenecarbonyl-β-oxy-1,4-phenyl-eneoxyteraphthaloyl) and poly(oxy-cis-1,4-cyclohexyleneoxycarbonyl-trans-1,4-cyclohexylenecarbonyl-β-oxy-1,4-phenyleneoxyterephthaloyl) in methylene chloride-o-cresol poly(oxy-trans-1,4-cyclohexylene oxycarbonyl-trans-1,4-cyclohexylenecarbonyl-b-oxy-(2-methyl-1,4-phenylene) oxy-terephthaloyl) in 1,1,2,2-tetrachloroethane-o-chlorophenol-phenol (60:25:15 vol/vol/vol), poly[oxy-trans-1,4-cyclohexyleneoxycarbonyl-trans-1,4-cyclohexylenecarbonyl-b-oxy(2-methyl-1,3-phenylene) oxy-terephthaloyl] in o-chlorophenol and the like; polyazomethines such as those prepared from 4,4'-diaminobenzanilide and terephthalaldehyde, methyl-1,4-phenylenediamine and terephthalaldehyde and the like; polyisocyanides such as poly(-phenyl ethyl isocyanide), poly(n-octyl isocyanide) and the like; polyisocyanates such as poly(n-alkyl isocyanates) as for example poly(n-butyl isocyanate), poly(n-hexyl isocyanate) and the like; lyotropic crystalline polymers with heterocyclic units such as poly(1,4-phenylene-2,6-benzobisthiazole) (PBT), poly(1,4-phenylene-2,6-benzobisoxazole) (PEO), poly(1,4-phenylene-1,3,4-oxadiazole), poly(1,4-phenylene-2,6-benzobisimidazole), poly[2,5(6)-benzimidazole] (AB-PBI), poly[2,6-(1,4-phenylene-4-phenylquinoline], poly[1,1'-(4,4'-biphenylene)-6,6'-bis(4-phenylquinoline)] and the like; polyorganophosphazines such as polyphosphazine, polybisphenoxyphosphazine, poly[bis(2,2,2'-trifluoroethylene) phosphazine] and the like; metal polymers such as those derived by condensation of trans-bis(tri-n-butylphosphine)platinum dichloride with a bisacetylene or trans-bis(tri-n-butylphosphine)bis(1,4-butadienyl)platinum and similar combinations in the presence of cuprous iodine and an amide; cellulose and cellulose derivatives such as esters of cellulose as for example triacetate cellulose, acetate cellulose, acetate-butyrate cellulose, nitrate cellulose, and sulfate cellulose, ethers of cellulose as for example, ethyl ether cellulose, hydroxymethyl ether cellulose, hydroxypropyl ether cellulose, carboxymethyl ether cellulose, ethyl hydroxyethyl ether cellulose, cyanoethylethyl ether cellulose, ether-esters of cellulose as for example acetoxyethyl ether cellulose and benzoyloxypropyl ether cellulose, and urethane cellulose as for example phenyl urethane cellulose; thermotropic liquid crystalline polymers such as celluloses and their derivatives as for example hydroxypropyl cellulose, ethyl cellulose propionoxypropyl cellulose; thermotropic copolyesters as for example copolymers of 6-hydroxy-2-naphthoic acid and p-hydroxy benzoic acid, copolymers of 6-hydroxy-2-naphthoic acid, terephthalic acid and p-amino phenol, copolymers of 6-hydroxy-2-naphthoic acid, terephthalic acid and hydroquinone, copolymers of 6-hydroxy-2-naphthoic acid, p-hydroxy benzoic acid, hydroquinone and terephthalic acid, copolymers of 2,6-naphthalene dicarboxylic acid, terephthalic acid, isophthalic acid and hydroquinone, copolymers of 2,6-naphthalene dicarboxylic acid and terephthalic acid, copolymers of p-hydroxybenzoic acid, terephthalic acid and 4,4'-dihydroxydiphenyl, copolymers of p-hydroxybenzoic acid, terephthalic acid, isophthalic acid and 4,4'-dihydroxydiphenyl, p-hydroxybenzoic acid, isophthalic acid, hydroquinone and 4,4'-dihydroxybenzophenone, copolymers of phenylterephthalic acid and hydroquinone, copolymers of chlorohydroquinone, terephthalic acid and p-acetoxy cinnamic acid, copolymers of chlorohydroquinone, terephthalic acid and ethylene dioxy-r,r'-dibenzoic acid, copolymers of hydroquinone, methylhydroquinone, p-hydroxybenzoic acid and isophthalic acid, copolymers of (1-phenylethyl)hydroquinone, terephthalic acid and hydroquinone, and copolymers of poly(ethylene terephthalate) and p-hydroxybenzoic acid; and thermotropic polyamides and thermotropic copoly (amide-esters).

Also illustrative of useful organic filaments are those composed of extended chain polymers formed by polymerization of α,β-unsaturated monomers of the formula:

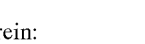

$$R_1R_2—C=CH_2$$

wherein:

$R_1$ and $R_2$ are the same or different and are hydrogen, hydroxy, halogen, alkylcarbonyl, carboxy, alkoxycarbonyl, heterocycle or alkyl or aryl either unsubstituted or substituted with one or more substituents selected from the group consisting of alkoxy, cyano, hydroxy, alkyl and aryl. Illustrative of such polymers of α,β-unsaturated monomers are polymers including polystyrene, polyethylene, polypropylene, poly(1-octadecene), polyisobutylene, poly(1-pentene), poly(2-methylstyrene), poly(4-methylstyrene), poly(1-hexene), poly(4-methoxystyrene), poly(5-methyl-1-hexene), poly(4-methylpentene), poly(1-butene), polyvinyl chloride, polybutylene, polyacrylonitrile, poly (methyl pentene-1), poly(vinyl alcohol), poly(vinyl acetate), poly(vinyl butyral), poly(vinyl chloride), poly (vinylidene chloride), vinyl chloride-vinyl acetate chloride copolymer, poly(vinylidene fluoride), poly(methyl acrylate), poly(methyl methacrylate), poly (methacrylonitrile), poly(acrylamide), poly(vinyl fluoride), poly(vinyl formal), poly(3-methyl-1-butene), poly(4-methyl-1-butene), poly(4-methyl-1-pentene), poly(1-hexane), poly(5-methyl-1-hexene), poly(1-octadecene), poly(vinyl cyclopentane), poly (vinylcyclohexane), poly(a-vinylnaphthalene), poly (vinyl methyl ether), poly(vinylethylether), poly(vinyl propylether), poly(vinyl carbazole), poly(vinyl pyrrolidone), poly(2-chlorostyrene), poly(4-chlorostyrene), poly(vinyl formate), poly(vinyl butyl ether), poly(vinyl octyl ether), poly(vinyl methyl ketone), poly(methylisopropenyl ketone), poly(4-phenylstyrene) and the like.

The most useful high strength fibers include extended chain polyolefin fibers, particularly extended chain polyethylene (ECPE) fibers, aramid fibers, polyvinyl alcohol fibers, polyacrylonitrile fibers, liquid crystal copolyester fibers, polyamide fibers, glass fibers, carbon fibers, polybenzoxazoles (PBO), polybenzothiazoles (PBT) and/or mixtures thereof Particularly preferred are the polyolefin and aramid fibers. If a mixture of fibers is used, it is preferred that the fibers be a mixture of at least two of polyethylene fibers, aramid fibers, polyamide fibers, carbon fibers, PBO fibers and glass fibers.

U.S. Pat. No. 4,457,985 generally discusses such extended chain polyethylene and polypropylene fibers, and the disclosure of this patent is hereby incorporated by reference to the extent that it is not inconsistent herewith. In the case of polyethylene, suitable fibers are those of weight average molecular weight of at least 150,000, preferably at least one million and more preferably between two million and five million. Such extended chain polyethylene fibers may be grown in solution as described in U.S. Pat. No. 4,137,394 or U.S. Pat. No. 4,356,138, or may be spun from a solution to form a gel structure, as described in German Off. 3,004,699 and GB 2051667, and especially as described in U.S. Pat. Nos. 4,413,110, 4,551,296, all of which are hereby incorporated by reference. As used herein, the term polyethylene shall mean a predominantly linear polyethylene material that may contain minor amounts of chain branching or comonomers not exceeding 5 modifying units per 100 main chain carbon atoms, and that may also contain admixed therewith not more than about 50 weight percent of one or more polymeric additives such as alkene-1-polymers, in particular low density polyethylene, polypropylene or polybutylene, copolymers containing mono-olefins as primary monomers, oxidized polyolefins, graft polyolefin copolymers and polyoxymethylenes, or low molecular weight additives such as antioxidants, lubricants, ultraviolet screening agents, colorants and the like which are commonly incorporated by reference. Depending upon the formation technique, the draw ratio and temperatures, and other conditions, a variety of properties can be imparted to these filaments. The tenacity of the filaments is at least about 15 g/d, preferably at least 20 g/d, more preferably at least 25 g/d and most preferably at least 30 g/d. Similarly, the tensile modulus of the filaments, as measured by an Instron tensile testing machine, is at least about 200 g/d, preferably at least 500 g/d, more preferably at least 1,000 g/d, and most preferably at least 1,200 g/d. These highest values for tensile modulus and tenacity are generally obtainable only by employing solution grown or gel filament processes. Many of the filaments have melting points higher than the melting point of the polymer from which they were formed. Thus, for example, high molecular weight polyethylene of 150,000, one million and two million generally have melting points in the bulk of 138° C. The highly oriented polyethylene filaments made of these materials have melting points of from about 7° to about 13° C. higher. Thus, a slight increase in melting point reflects the crystalline perfection and higher crystalline orientation of the filaments as compared to the bulk polymer.

Similarly, highly oriented extended chain polypropylene fibers of weight average molecular weight at least 200,000, preferably at least one million and more preferably at least two million, may be used. Such extended chain polypropylene may be formed into reasonably well oriented filaments by techniques described in the various references referred to above, and especially by the technique of U.S. Pat. Nos. 4,413,110, 4,551,296, 4,663,101, and 4,784 820, hereby incorporated by reference. Since polypropylene is a much less crystalline material than polyethylene and contains pendant methyl groups, tenacity values achievable with polypropylene are generally substantially lower than the corresponding values for polyethylene. Accordingly, a suitable tenacity is at least about 8 g/d, with a preferred tenacity being at least about 11 g/d. The tensile modulus for polypropylene is at least about 160 g/d, preferably at least about 200 g/d. The melting point of the polypropylene is generally raised several degrees by the orientation process, such that the polypropylene filament preferably has a main melting point of at least 168° C., more preferably at least 170° C. The particularly preferred ranges for the above-described parameters can be advantageously provide improved performance in the final article. Employing fibers having a weight average molecular weight of at least about 200,000 coupled with the preferred ranges for the above-described parameters (modulus and tenacity) can provide advantageously improved performance in the final article.

High molecular weight polyvinyl alcohol fibers having high tensile modulus are described in U.S. Pat. No. 4,440,711, which is hereby incorporated by reference to the extent it is not inconsistent herewith. High molecular weight PV-OH fibers should have a weight average molecular weight of at least about 200,000. Particularly useful PV-OH fibers should have a modulus of at least about 300 g/d, a tenacity of at least about 7 g/d (preferably at least about 10 g/d, more preferably about 14 g/d, and most preferably at least about 17 g/d), and an energy-to-break of at least about 8 joules/g. PV-OH fibers having a weight average molecular weight of at least about 200,000, a tenacity of at least about 10 g/d, a modulus of at least about 300 g/d, and an energy to break of about 8 joules/g are likely to be more useful in producing articles of the present invention. PV-OH fibers having such properties can be produced, for example, by the process disclosed in U.S. Pat. No. 4,599,267, hereby incorporated by reference.

In the case of polyacrylonitrile (PAN), PAN fibers for use in the present invention are of molecular weight of at least about 400,000. Particularly useful PAN fiber should have a tenacity of at least about 10 g/d and an energy-to-break of at least about 8 joules/g. PAN fibers having a molecular weight of at least about 400,000, a tenacity of at least about 15 to about 20 g/d and an energy-to-break of at least about 8 joules/g are most useful; such fibers are disclosed, for example, in U.S. Pat. No. 4,535,027, hereby incorporated by reference.

In the case of aramid fibers, suitable aramid fibers formed principally from aromatic polyamide are described in U.S. Pat. No. 3,671,542, hereby incorporated by reference. Preferred aramid fiber will have a tenacity of at least about 20 g/d, a tensile modulus of at least about 400 g/d and an energy-to-break at least about 8 joules/g, and particularly preferred aramid fiber will have a tenacity of at least about 20 g/d, a modulus of at least about 480 g/d and an energy-to-break of at least about 20 joules/g. Most preferred aramid fibers will have a tenacity of at least about 20 g/d, a modulus of at least about 900 g/d and an energy-to-break of at least about 30 joules/g. For example, poly(phenylenediamine terephthalamide) filaments produced commercially by Dupont Corporation under the trade name of KEVLAR® 29, 49, 129 and 149 and having moderately high moduli and tenacity values are particularly useful in forming articles of the present invention. KEVLAR 29 has 500 g/d and 22 g/d and KEVLAR 49 has 1000 g/d and 22 g/d as values of modulus and tenacity, respectively. Also useful in the practice of this invention is poly(metaphenylene isophthalamide) fibers produced commercially by Dupont under the trade name NOMEX®.

In the case of liquid crystal copolyesters, suitable fibers are disclosed, for example, in U.S. Pat. Nos. 3,975,487; 4,118,372; and 4,161,470, hereby incorporated by reference. Tenacity's of about 15 to about 30 g/d and preferably about 20 to about 25 g/d, and tensile modulus of about 500 to 1500 g/d and preferably about 1000 to about 1200 g/d are particularly desirable.

If a matrix material is employed in the practice of this invention, it may comprise one or more thermosetting resins, or one or more thermoplastic resins, or a blend of such resins. The choice of a matrix material will depend on how the bands are to be formed and used. The desired rigidity of the band and/or ultimate container will greatly influence choice of matrix material. As used herein "thermoplastic resins" are resins which can be heated and softened, cooled and hardened a number of times without undergoing a basic alteration, and "thermosetting resins" are resins which cannot be resoftened and reworked after molding, extruding or casting and which attain new, irreversible properties when once set at a temperature which is critical to each resin.

The tensile modulus of the matrix material in the band(s) may be low (flexible) or high (rigid), depending upon how the band is to be used. The key requirement of the matrix material is that it be flexible enough to process at whatever stage of the band-forming method it is added. In this regard, thermosetting resins which are fully uncured or have been B-staged but not fully cured would probably process acceptably, as would fully cured thermosetting resins which can be plied together with compatible adhesives. Heat added to the process would permit processing of higher modulus thermoplastic materials which are too rigid to process otherwise; the temperature "seen" by the material and duration of exposure must be such that the material softens for processing without adversely affecting the impregnated fibers, if any.

With the foregoing in mind, thermosetting resins useful in the practice of this invention may include, by way of illustration, bismaleimides, alkyds, acrylics, amino resins, urethanes, unsaturated polyesters, silicones, epoxies, vinylesters and mixtures thereof. Greater detail on useful thermosetting resins may be found in U.S. Pat. No. 5,330,820, hereby incorporated by reference. Particularly preferred thermosetting resins are the epoxies, polyesters and vinylesters, with an epoxy being the thermosetting resin of choice.

Thermoplastic resins for use in the practice of this invention may also vary widely. Illustrative of useful thermoplastic resins are polylactones, polyurethanes, polycarbonates, polysulfones, polyether ether ketones, polyamides, polyesters, poly(arylene oxides), poly(arylene sulfides), vinyl polymers, polyacrylics, polyacrylates, polyolefins, ionomers, polyepichlorohydrins, polyetherimides, liquid crystal resins, and elastomers and copolymers and mixtures thereof. Greater detail on useful thermoplastic resins may be found in U.S. Pat. No. 5,330,820, hereby incorporated by reference. Particularly preferred low modulus thermoplastic (elastomeric) resins are described in U.S. Pat. No. 4,820,568, hereby incorporated by reference, in columns 6 and 7, especially those produced commercially by the Shell Chemical Co. which are described in the bulletin "KRATON Thermoplastic Rubber", SC-68-81. Particularly preferred thermoplastic resins are the high density, low density, and linear low density polyethylenes, alone or as blends, as described in U.S. Pat. No. 4,820,458. A broad range of elastomers may be used, including natural rubber, styrene-butadiene copolymers, polyisoprene, polychloroprene-butadiene-acrylonitrile copolymers, ER rubbers, EPDM rubbers, and polybutylenes.

In the preferred embodiments of the invention, the matrix comprises a low modulus polymeric matrix selected from the group consisting of a low density polyethylene; a polyurethane; a flexible epoxy; a filled elastomer vulcanizate; a thermoplastic elastomer; and a modified nylon-6.

The proportion of matrix to filament in the bands is not critical and may vary widely. In general, the matrix material forms from about 10 to about 90% by volume of the fibers, preferably about 10 to 80%, and most preferably about 10 to 30%.

If a matrix resin is used, it may be applied in a variety of ways to the fiber, e.g., encapsulation, impregnation, lamination, extrusion coating, solution coating, solvent coating. Effective techniques for forming coated fibrous layers suitable for use in the present invention are detailed in referenced U.S. Pat. Nos. 4,820,568 and 4,916,000.

The blast resistant bands can be made according to the following method steps:

A. wrapping at least one flexible sheet comprising a high strength fiber material around a mandrel in a plurality of layers under tension sufficient to remove voids between successive layers;

B. securing the layers of material together to form a substantially seamless and at least partially rigid first band; and C. removing the band from the mandrel. The wrapping tension typically is in the range of from about 0.1 to 50 pounds per linear inch, more preferably in the range of from about 2 to 50 pounds per linear inch, most preferably in the range of from about 2 to 20 pounds per linear inch. The fabric layers can be secured in a variety of ways, e.g., by heat and/or pressure bonding, heat shrinking, adhesives, staples, and sewing, as discussed above. It is most preferred that the securing step comprises the steps of contacting the fiber material with a resin matrix and consolidating the layers of high strength fiber material and the resin matrix either on or off of the mandrel. The fiber material can be contacted with a resin matrix either before, during or after the wrapping step. Some of the ways in which this can be done are detailed further below. By "consolidating" is meant combining the matrix material and the fiber network into a single unitary layer. Depending upon the type of matrix material and how it is applied to the fibers, consolidation can occur via drying, cooling, pressure or a combination thereof, optionally in combination with application of an adhesive. "Consolidating" is also meant to encompass spot consolidation wherein the faces of a band are consolidated but the edges are not. In this fashion, the faces can be made rigid while the edges retain the ability to bend or be bent to permit collapsing or folding of the band. "Sheet" is meant to include a single fiber or roving for purposes of this invention.

Another method of making bands for assembly into a blast resistant container comprises the steps of:

A. wrapping a first flexible sheet of a high strength fiber material around a mandrel in a plurality of layers under sufficient tension to remove voids between successive layers to form a first band;

B. contacting the high strength fiber material of the first flexible sheet with a resin matrix;

C. placing spacing means on the exterior of the first band;

D. wrapping a second flexible sheet of a high strength fiber material around the spacing means in a plurality of layers under sufficient tension to remove voids between successive layers to form a second band;

E. contacting the high strength fiber material of the second flexible sheet with a resin matrix;

F. placing second spacing means on the exterior of the second band;

G. wrapping a third flexible sheet of a high strength fiber material around the second spacing means in a plurality of layers under sufficient tension to remove voids between successive layers to form a third band:

H. contacting the high strength fiber of the third flexible sheet with a resin matrix;

I. repeating the placing, wrapping, and contacting steps to create a desired number of bands;

J. consolidating at least a part of each of the bands on the mandrel; and

K. removing the bands and spacing means from the mandrel.

This method allows formation of all of the bands for a single container at one time.

In one preferred embodiment, the flexible sheet material is formed as follows. Yarn bundles of from about 30 to about 2000 individual filaments of less than about 12 denier, and more preferably of about 100 individual filaments of less than about 7 denier, are supplied from a creel, and are led through guides and a spreader bar into a collimating comb just prior to coating. The collimating comb aligns the filaments coplanarly and in a substantially parallel, and unidirectional fashion. The filaments are then sandwiched between release papers, one of which is coated with a wet matrix resin. This system is then passed under a series of pressure rolls to complete the impregnation of the filaments. The top release paper is pulled off and rolled up on a take-up reel while the impregnated network of filaments proceeds through a heated tunnel oven to remove solvent and then be taken up. Alternatively, a single release paper coated with the wet matrix resin can be used to create the impregnated network of filaments. One such impregnated network is referred to as unidirectional prepreg, tape or sheet material and is one of the preferred feed materials for making some of the bands in the examples below.

In an alternate embodiment of this invention, two such impregnated networks are continuously cross plied, preferably by cutting one of the networks into lengths that can be placed successively across the width of the other network in a 0°/90° orientation. This forms a continuous flexible sheet of high strength fiber material. See U.S. Pat. No. 5,173,138, hereby incorporated by reference. This flexible sheet (fibrous layer), optionally with film as discussed below, can then be used to form one or more bands in accordance with the methods of the present invention. This fibrous layer is sufficiently flexible to wrap in accordance with the methods of the present invention; it can then be made substantially rigid (per the drapability test), if desired, either by the sheer number of wraps or by the manner in which it is secured. The weight percent of fiber in the hoop direction of the band can be varied by varying the number and the orientation of the networks. One way to achieve varying weight percents of fiber in the hoop direction is to make a composite sheet from the cross plied material and one or more layers of unidirectional tape/material (see the examples which follow). By way of example, two unidirectional sheets with one cross-plied sheet forms an imbalanced fabric having about 75 weight percent fiber in the hoop direction.

In another embodiment, one or more uncured thermosetting resin-impregnated networks of high strength filaments are similarly formed into a flexible sheet for winding around a mandrel into a band or bands in accordance with the present invention followed by curing (or spot curing) of the resin.

Film may optionally be used as one or more layers of the band(s), preferably as an outer layer. The film, or films, can be added as the matrix material (lamination), with the matrix material or after the matrix material, as the case may be. When the film is added as the matrix material, it is preferably simultaneously wound with the fiber or fabric (network) onto a mandrel and subsequently consolidated; the mandrel may optionally become part of the structure. The film thickness minimally is about 0.1 mil and may be as large as desired so long as the length is still sufficiently flexible to permit band formation. The preferred film thickness ranges from 0.1 to 50 mil, with 0.35 to 10 mil being most preferred. Films can also be used on the surfaces of the bands for a variety of reasons, e.g., to vary frictional properties, to increase flame retardance, to increase chemical resistance, to increase resistance to radiation degradation, and/or to prevent diffusion of material into the matrix. The film may or may not adhere to the band depending on the choice of film, resin and filament. Heat and/or pressure may cause the desired adherence, or it may be necessary to use an adhesive which is heat or pressure sensitive between the film and the band to cause the desired adherence. Examples of acceptable adhesives include polystyrene-polyisoprene-polystyrene block copolymer, thermoplastic elastomers, thermoplastic and thermosetting polyurethanes, thermoplastic and thermosetting polysulfides, and typical hot melt adhesives.

Films which may be used as matrix materials in the present invention include thermoplastic polyolefinic films, thermoplastic elastomeric films, crosslinked thermoplastic films, crosslinked elastomeric films, polyester films, polyamide films, fluorocarbon films, urethane films, polyvinylidene chloride films, polyvinyl chloride films and multilayer films. Homopolymers or copolymers of these films can be used, and the films may be unoriented, uniaxially oriented or biaxially oriented. The films may include pigments or plasticizers.

Useful thermoplastic polyolefinic films include those of low density polyethylene, high density polyethylene, linear low density polyethylene, polybutylene, and copolymers of ethylene and propylene which are crystalline. Polyester films which may be used include those of polyethylene terephthalate and polybutylene terephthalate.

Pressure can be applied by an interleaf material made from a plastic film wrap which shrinks when the band is exposed to heat; acceptable materials for this application, by way of example, are polyethylene, polyvinyl chloride and ethylene-vinylacetate copolymers.

The temperatures and/or pressures to which the bands of the present invention are exposed to cure the thermosetting resin or to cause adherence of the networks to each other and optionally, to at least one sheet of film, vary depending upon the particular system used. For example, for extended chain polyethylene filaments, temperatures range from about 20° C. to about 150° C., preferably from about 50° C. to about 145° C., more preferably from about 80° C. to about 120° C., depending on the type of matrix material selected. The pressures may range from about 10 psi (69 kPa) to about 10,000 psi (69,000 kPa). A pressure between about 10 psi (69 kPa) and about 500 psi (3450 kPa), when combined with temperatures below about 100° C. for a period of time less than about 1.0 min., may be used simply to cause adjacent filaments to stick together. Pressures from about 100 psi (690 kPa) to about 10,000 psi (69,000 kPa), when coupled with temperatures in the range of about 100° C. to about 155° C. for a time of between about 1 to about 5 min., may cause the filaments to deform and to compress together (generally in a film-like shape). Pressures from about 100 psi (690 kPa) to about 10,000 psi (69,000 kPa), when coupled with temperatures in the range of about 150° C. to about 155° C. for a time of between 1 to 5 min., may cause the film to become translucent or transparent. For polypropylene filaments, the upper limitation of the temperature range would be about 10 to about 20° C. higher than for ECPE filament. For aramid filaments, especially Kevlar filaments, the temperature range would be about 149 to 205° C. (about 300 to 400° F.).

Pressure may be applied to the bands on the mandrel in a variety of ways. Shrink wrapping with plastic film wrap is mentioned above. Autoclaving is another way of applying pressure, in this case simultaneous with the application of heat. The exterior of each band may be wrapped with a shrink wrappable material and then exposed to temperatures which will shrink wrap the material and thus apply pressure to the band. The band can be shrink wrapped on the mandrel in its hoop direction which will consolidate the entire band, or the band can be shrink wrapped across its faces with material placed around the band wrapped mandrel perpendicular to the hoop direction of the band; in the latter case, the edges of the band can remain unconsolidated while the faces are consolidated.

Many of the bands formed with fibrous layers utilizing elastomeric resin systems, thermosetting resin systems, or resin systems wherein a thermoplastic resin is combined with an elastomeric or thermosetting resin can be treated with pressure alone to consolidate the band. This is the preferred way of consolidating the band. However, many of the bands formed with continuous lengths/plies utilizing thermoplastic resin systems can be treated with heat, alone or combined with pressure, to consolidate the band.

In the most preferred embodiments, each fibrous layer has an areal density of from about 0.1 to about 0.15 kg/m$^2$. The areal density per band ranges from about 1 to about 40 kg/m$^2$, preferably from about 2 to 20 kg/m$^2$, and more preferably from about 4 to about 10 kg/m$^2$. In the embodiment where SPECTRA SHIELD® composite nonwoven fabric forms a fibrous layer, these areal densities correspond to a number of fibrous layers per band ranging from about 10 to about 400, preferably from about 20 to about 200, more preferably from about 40 to about 100. In the three band cube design of the most preferred embodiment of the present invention, each face of the cube comprises two bands of blast resistant material, which effectively doubles the aforesaid ranges for each face of the cube. Where fibers other than high strength extended chain polyethylene, like SPECTRA® polyethylene fibers, are utilized the number of layers may need to be increased to achieve the high strength and modulus characteristics provided by the preferred embodiments.

By blast mitigating material is meant any material that functionally improves the resistance of the container to blast. The preferred blast mitigating material utilized in forming the container assemblies of the present invention are polymeric foams; particulates, such as vermiculite; condensable gases, preferably nonflammable; heat sink materials; foamed glass; microballoons; balloons; bladders; hollow spheres, preferably elastomeric such as basketballs and tennis balls; wicking fibers; and combinations thereof These materials are used to surround the explosive or explosive-carrying luggage within the blast resistant container, and mitigate the shock wave transmitted by an explosion.

Chemical explosions are characterized by a rapid self-propagating decomposition which liberates considerable heat and develops a sudden pressure effect through the action of heat on the produced or adjacent gases. On a weight basis, the heat of vaporization of water is similar to the heat liberated by the explosive. Provided that rapid heat transfer can be accomplished, water has the potential of greatly decreasing the blast overpressure. One technique to achieve the desired effect is to surround the explosive with heat sink materials. Effective heat sink materials include aqueous foams; aqueous solutions having antifreeze therein such as glycerin, ethylene glycol; hydrated inorganic salts; aqueous gels, preferably reinforced; aqueous mists; wet sponges, preferably elastomeric; wet profiled fibers; wet fabrics; wet felts; and combinations thereof Aqueous foams are most preferred, especially aqueous foams having a density in the range of from about 0.01 to about 0.10 g/cm$^3$, more preferably in the range of from about 0.03 to about 0.08 g/cm$^3$.

In general, aqueous foams, through a number of mechanisms, transform energy of the explosion to heat energy within the aqueous phase. After an explosion venting of gases occurs in most containers, and when the pressure drops below some critical value the collapsed foam expands again causing additional slow release of gases. The presence of these foams decreases the rate at which energy is transmitted from the container to the surroundings, and thereby decreases the hazard. Aqueous foams for use with this invention are preferably prepared with gases (foaming agents) which do not support combustion and that are condensable. By condensable is meant that under pressure the gas will change phase from gas to liquid, simultaneously evolving their heat of condensation which heats the aqueous solution with which the gas has intimate contact. The gas selected for a particular application will depend on ambient temperature and on the pressure that the container (within which the gas is placed) can withstand. Preferred gases include the hydrocarbons such as propane, butane (both isomers), and pentane(all isomers); carbon dioxide; inorganic gases such as ammonia, sulfur dioxide; fluorocarbons, particularly the hydrochlorofluorocarbons and the hydrofluorocarbons, such as, for example, the GENETRON® series of refrigerants commercially available from AlliedSignal Inc. as set forth in the AlliedSignal GENETRON® Products Brochure, published January, 1995, and hereby incorporated by reference; and combinations thereof. A preferred gas is isobutane, which can be condensed at modest pressures, about 30 psi at room temperature. Mixtures of condensable and non-condensable gases can be used. For example, a mixture of isobutane and tetrafluoromethane can be used for a room temperature application. The blast overpressure would cause the isobutane to condense but the tetrafluoromethane would remain gaseous. Preferred gases have low sonic velocities.

In order to rapidly dispense aqueous foams, it may be desirable to use a gas that does not condense in the pressurized canister, in combination with a condensed gas. Carbon dioxide, nitrogen, nitrous oxide or carbon tetrafluoride could serve as such as gas. Gases which vaporize to provide propellant action cool the canister during dispensing and the rate of discharge slows.

Considerations which are used for selection of foaming agent for an aqueous foam can also be used in selection of condensable gases to be used as the blast mitigating material in collapsible containers (in the absence of aqueous foam). Such gases can conveniently be confined in bladders within the containers.

The following examples are presented to provide a more complete understanding of the invention and are not to be construed as limitations thereon. In the examples, the following technical terms are used:

(a) "Areal Density" is the weight of a structure per unit area of the structure in kg/m$^2$. Panel areal density is determined by dividing the weight of the panel by the area of the panel. For a band having a polygonal cross-sectional area, areal density of each face is given by the weight of the face divided by the surface area of the face. In most cases, the areal density of all faces is the same, and one can refer to the areal density of the structure. However in some cases the areal density of the different faces is different. For a band having a circular cross-sectional area, areal density is determined by dividing the weight of the band by the exterior surface area of the band. For a cubic box container, the areal density is the areal density of each of the six panels forming the faces of the box and does not include the areal density of any hinges or pins.

(B) "Fiber Areal Density of a Composite" corresponds to the weight of the fiber reinforcement per unit area of the composite.

Containers of this invention may be required to provide protection against high explosives or a combination of high explosives plus shrapnel. M67 hand grenades and pipe bombs are examples of such combined. Portable blast protection containers will not vary greatly in size and consequently the impacting velocity of the shrapnel on the walls will not vary greatly for any given threat. In addition, the use of blast mitigating materials, such as aqueous foams, are not expected to significantly affect the velocity of shrapnel impacting the walls. Experience with M67 hand grenades indicates that wall areal density of SpectraShield should be at least 5.7 lb./ft.$^2$(28 kg/m$^2$) in order to provide full protection. That areal density corresponds to the sum of the areal density of two bands.

In the examples that follow, the explosive used was either a modified M67 fragmentation hand grenade, C4, and/or a pipe bomb.

An M67 fragmentation hand grenade was modified so that it could be detonated electronically. The M67 grenade weighed 14 ounces and incorporated 6.5 ounces of compound B explosive. For greater detail on this standard hand grenade, reference may be had to *Guide Book for Marines,* 15th Revised Edition, Quantico, Va., p.352, 09/01/86, hereby incorporated by reference. The grenade was placed in the geometrical center of the container and detonated.

C4 is 90 percent RDX (cyclo-1,3,5-trimethylene-2,4,6-trinitroamine) and 10 percent of a plasticizer (polyisobutylene), a product of Hitech Inc., and a class A explosive having a shock wave velocity of 8200 b/sec (26,900 ft/sec).

A pipe bomb was constructed from a seven inch length of 2-inch diameter Schedule 40 galvanized pipe (wall thickness 0.138 inch). Pipe weight, with end caps, was 3.3 lb. The pipe was loaded with 0.50 lb. of Bullseye powder, a commercial product of Alliant Powder Company. An Ireco Super SP detonator was used to set off the charge.

The specific techniques, conditions, materials, proportions and reported data set forth to illustrate the principles of the invention are exemplary and should not be construed as limiting the scope of the invention.

EXAMPLE 1

This example details container slit design. Although the materials utilized are characterized by lower tenacity than the preferred materials of construction, they are adequate to demonstrate the accessibility via a slit in the band concept for the containers of the present invention.

A three band container (Container A) consisting of inner, middle, and outer fabric bands was constructed from nylon 6 fabric (JPS Converter and Industrial Corp., Style OW4417, areal density 0.236 kg/m$^2$, plain weave, 630 denier yarn). The inner and middle bands were sewn together and a 14" long slit was cut into both 15-inch square faces of the 15"×15"×24" container. Total container weight was 34.7 lb. and each band consisted of 20 wraps of fabric.

In order to construct the inner band, fabric 30 inches wide was wrapped onto a wooden mandrel (15"×15"×30") using low but constant tension. After 10 wraps, support sheets of high density polyethylene (HDPE, 24"long×15" wide× 0.0625 inch thick) were placed on the fabric on two opposing sides and sewn to the fabric through holes drilled in the corners. A sewing thread consisting of three yarns of 185 denier SPECTRA 1000 yarn was used. Fabric wrapping continued for 10 more fabric wraps to complete the band for a total of 20 wraps (see FIG. 1). The edges of the band were first sewn by sliding the 20 fabric layers to one edge of the mandrel. Three inches in from the edge, the fabric layers were folded along each side length to form a lip (see FIG. 2). The corners were folded and stitched. After one edge was complete, the wooden mandrel was removed from the center and a collapsible cardboard mandrel (15"×15"×24") was inserted into the inner band (replacing the wooden mandrel) to create sufficient rigidity of the inner band so that the middle and outer bands could be wrapped onto it. A three-inch flap was folded and stitched on the opposite side. The inner band then had flaps on both edges. This inner band weighed 13 lb.

The middle band was wrapped around the inner band to create a rectangular band with 15" and 24" alternating side lengths (perimeter 78 inches); band width was 14.5 inches. Nylon 6 fabric (14.75 inches wide) was wrapped onto the inner band using low but constant tension. The middle band wrapping direction covered the open ends of the inner band (FIG. 2). The middle band consisted of 20 wraps of fabric and weighed 8.5 lb. The inner and middle bands were sewn together along the edge of the middle band.

The outer band was similar to the middle band. Nylon 6 fabric (15.25 inches wide) was wrapped in the direction shown in FIG. 2 using no shims. After two fabric wraps, HDPE sheets were placed on each side length (2 pieces 15.75"×15" and 2 pieces 15.75"×24"). After two fabric wraps were complete, these sheets were stitched to the fabric using holes drilled at each corner and at the middle of each edge. Fabric wrapping was continued to obtain 20 wraps total. The band was then stitched around its edges. This band contained 8.5 lb. of fabric.

A 14 inch long slit through all 20 layers of middle band fabric was cut in the center of both 15"×15" sides in the hoop direction, using a heated knife. A cradle was created inside the container cavity in the following manner. Three pieces of 27" long nylon 6 webbing (1.75" wide) were sewn into the top edge of the inner band, six inches apart, and allowed to drape into the box. Nylon 6 fabric (27"×7") two layers thick, connected the nylon webbing with the box. This created a suspended shelf of fabric 5 inches off the bottom of the box, supported in three places by the nylon webbing, which could be used to hold suspect packages, pipe bombs etc.

In order to create cross-member support, four pieces of ½" diameter nylon 6 extruded tubing, 15 inches in length, were placed into the four corners of the middle band to span corner to corner of the rigid side panels/faces. Each piece of tubing was held in place by creating a snug fit between the side panels. One end of each tube was sewn into the inner band to allow collapsibility.

Figure 3:
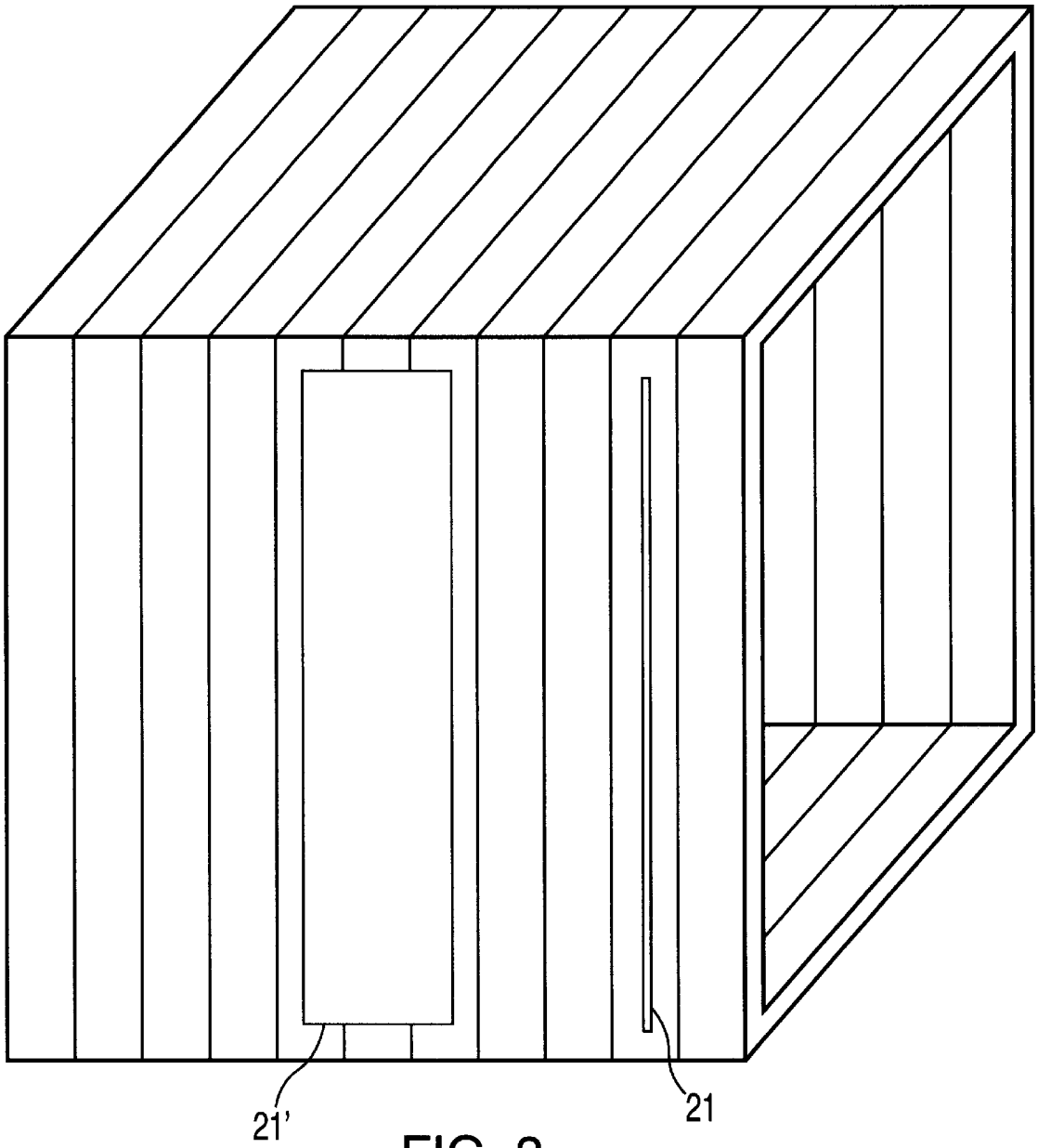
FIG. 3 is a three dimensional view of alternate band 20 of the present invention.
Figure 4A:
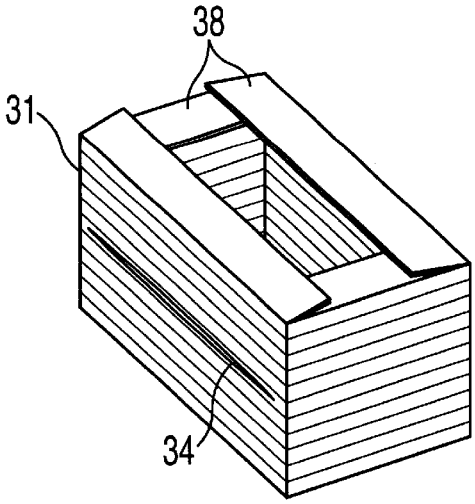
Figure 4B:
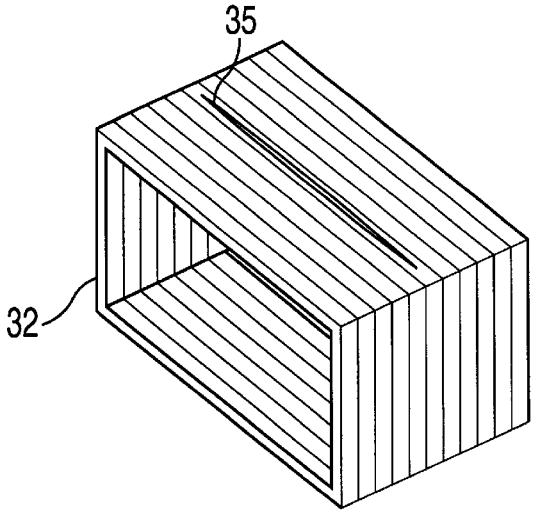
Figure 4C:
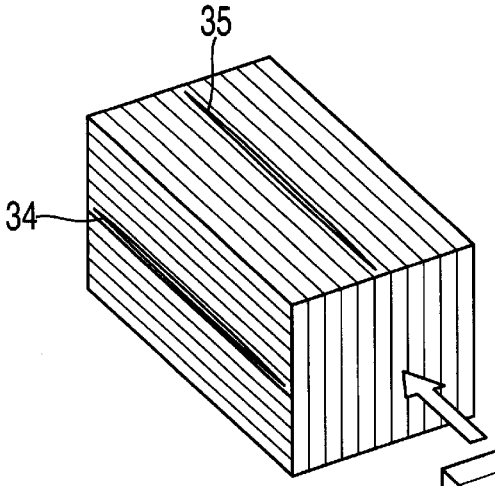
Figure 4D:
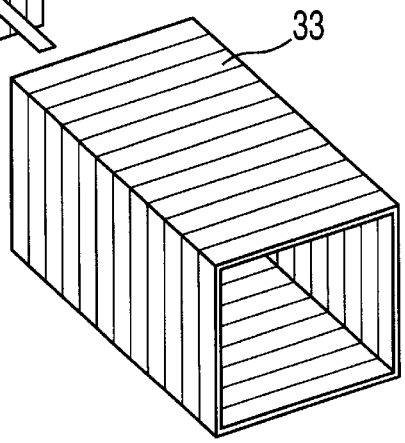
Figure 4E:
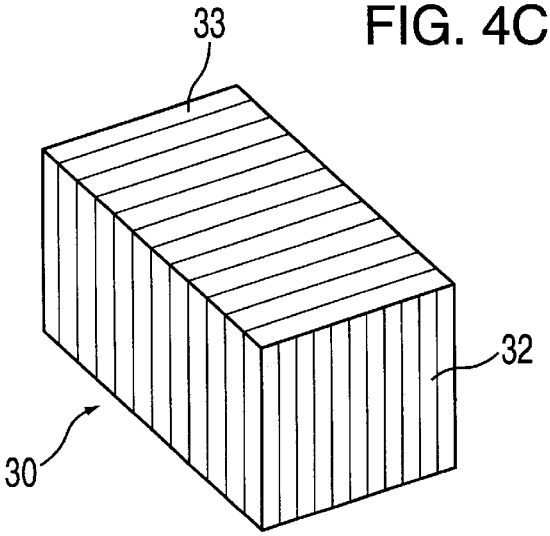

Handles were attached to the container using nylon 6 webbing (1.75" wide). On the under side of the middle band two 50" lengths were attached to each corner of a short side (15"), to form two long-loop handles (FIG. 3). On the outer band, handle loops made of nylon 6 webbing (4" long×0.75" wide) were sewn into the top outer edges. When the outer band is placed onto the assembled inner/middle band box, the long loop handles pass up through the small handle loops on the outer band to thereby hold the box and outer band together. This also eliminates listing of the box from side to side during transport.

The combined inner and middle bands (sewn together) can be collapsed to a rectangular shape 16"×25"×6". The outer band can be collapsed to a 16"×40"×0.75" rectangular shape. Because the cross section of the outer band is not square, edges do not line up for folding. In this case, with the flexible HDPE panels, the outer band could be folded to dimensions of 16"×25"×6".

The 14-inch slit, when pulled at the center, formed a square having side lengths of 7 inches and a diagonal of 9 inches. Only relatively small packages could be inserted and removed. In addition it was difficult to examine a package within the container.

A second container (Container B) was formed similar to Container A, except that the slit was on the longer side. In order to accomplish this the orientation of the inner and the outer bands was reversed. The inner band was wound on a rectangular mandrel having side lengths of 15 and 24 inches and a band width of 22 inches, to allow for 3-inch flaps. A 24-inch slit was cut into the center line of one face of the middle band (fibers in the hoop direction were left uncut). The inner and the middle bands were sewn together in the same manner as Container A.

The combined inner and middle bands (sewn together) can be collapsed to a rectangular shape 16"×25"×6". The outer band can be collapsed to a 26"×32"×0.50" rectangular shape. Because the cross section of the outer band is square, edges line up for folding and the outer band can be folded to yield a package 26"×16"×1.5". This is a distinct advantage for stowing, compared with the outer band of Container A. Placing the slit on the large face greatly improved the access to the container.

The 23-inch slit, when pulled at the center, formed a rhombus having side lengths of 11 inches and diagonal lengths of 17 and 14 inches. Larger packages could be inserted and removed due to the diagonals.

Container C was formed in the following manner. Onto a solid wooden mandrel (15.5"×15.5"×25") was wound a combination of SpectraShield (areal density 0.135 kg/m$^2$) and its unidirectional precursor (SpectraShield is 0/90 cross-ply of the unidirectional precursor, both commercially available from AlliedSignal Inc.). Wrapping was carried out to form a four-sided band having side lengths of 15.5" and 24". Band width was 15.5 inches. Wrapping was carried out in the following sequence: 10 wraps of SpectraShield, followed by 40 wraps of unitape precursor, followed by 10 wraps of SpectraShield.

The wrapped mandrel was placed in a hydraulic press and force of 15 tons was applied to the top and bottom of the mandrel for 30 minutes at platen temperature of 125° C. The orientation of the mandrel was changed and the other two sides were molded in an identical manner. This molded band constituted the middle band of Container C.

The outer band was molded from the same mandrel, butusing shims to make it slightly larger. The SpectraShield and unitape were wrapped to give the same construction and areal density as that of the middle band. The outer band was 15.75 inches square in cross-section and band width was 27 inches.

The inner band was constructed from 20 wraps of nylon 6 fabric, 21.5 inches wide. Flaps were created in the same manner as with container A. The inner band was sewn to the middle band at 12 points (each corner and the middle of each long side). A 24-inch long slit was cut in the center of one of the exposed faces. This container is not collapsible.

The access to this container behaved similar to that of Container B. The opening was identical in size and shape when the slit was distorted. However, it was evident that the inner band could be attached to the middle band with elastic material, which would allow for considerable distortion of the shape of the opening.

A nylon 6 fabric container (Container D) was constructed from 3 bands having a height of 24 inches, width of 18 inches, and length of 34 inches, as a model for a collapsible container which could be use in the passenger cabin of commercial aircraft. The inner band was wound around the sides (initial band width was 30 inches, to allow for 3-inch flaps on both sides of the inner band). HDPE panels 23"×33" were sewn into the 34"×24" faces of the inner band. The middle band (18 inches wide) was wrapped around the top, bottom, and sides (perimeter of 116 inches). The inner and middle bands were sewn together in the same manner as container N2, and a slit 34 inches long was cut along the center line of the top. The outer band was wound to produce rectangular band 24"×18" in cross-section and 34 inches wide. Into each face was sewn a HPDE sheet having dimensions 2 inches less than the dimensions of the face.

The combined inner and middle bands could be collapsed to 33.5"×25"×5.5". The outer band can be collapsed to 43"×34"×0.75". Since the edges do not line up, the outer band does not fold efficiently—a package 22"×34"×4" is obtained.

The 30.5-inch slit, when pulled at the center, formed a rhombus having side lengths of 15 inches and diagonal lengths of 16 and 16 inches. The slits in the fabric bands were easily distorted and could accommodate irregular shaped packages. The addition of 4 inches of flexible foam to the bottom of the container had no adverse effect on the slit opening. Such a foam could be used to prevent a charge being placed directly against the floor of a container.

Comments

Containers of this invention are designed to find use as protection against bombs, explosive, grenades etc., and consequently it is highly desirable that they can be closed quickly. The same individual inserted a wooden block, 6"×2"×4", into each of the containers, once with the outer band collapsed and once with the outer band deployed in appropriate shape. In every instance, it was faster to insert the block with the outer band deployed. Hybrid-1 was easier to load than N−1 which was easier to load than N−2 which was easier to load than N−3. This was repeated with two individuals working together to insert the block into the containers. The results obtained were similar. Use of a slit allowed the inner and middle bands to be attached, which permitted simple and rapid closure of the blast resistant container.

EXAMPLE 2

Container 1 for this example was formed as follows. Onto a solid wooden mandrel (15.5"×15.5"×25") was wound a combination of SpectraShield (areal density 0.135 kg/m$^2$) and its unidirectional precursor (SpectraShield is 0/90 cross-ply of the unidirectional precursor). Wrapping was carried out to form a four-sided band having side lengths of 15" and 24". Band width was 15 inches. Wrapping was carried out in the following sequence: 10 wraps of SpectraShield, followed by 40 wraps of uni-tape precursor, followed by 10 wraps of SpectraShield. The wrapped mandrel was placed in a hydraulic press and force of 15 tons was applied to the top and bottom of the mandrel for 30 minutes at platen temperature of 125° C. The orientation of the mandrel was changed and the other two sides were molded in an identical manner. This molded band constituted the inner band.

The middle band was constructed in the same manner using shims to make the band slightly larger than the inner band. The band width of the middle band was 15.5 inches.

The outer band was molded from the same mandrel (using shims to make it slightly larger than the middle band). The SpectraShield and uni-tape were wrapped to give the same construction and areal density of the middle band. The outer band was 15.75 inches square in cross-section and band width was 27 inches. Container weight was 35.6 lb.

Container 2 of this example was identical to container 1 with the following exceptions. The length of SpectraShield and unitape was increased by a factor of 1.7 for each band. Additional SpectraShield protection was added to edges not protected by flaps. A 16 inch wide strip of SpectraShield was wound around a 4"×4" wooden mandrel and molded in the usual manner to create a consolidated tube. This tube was then cut to form four L-beams 16 inches long. These L beams were inserted into the inner band and fixed in place with double stick tape to give further protection to the edges not covered by the flaps on the inner band. Container weight was 66 lb.

Container 3 of this example is constructed using Spectra 1000 fabric (Clark-Schwebel style 955). The inner band is constructed by wrapping a 35 inch wide strip of fabric 28 times around a 28 inch square mandrel. Flaps are sewn into place to create a 28 inch square band with 8.5 inch flaps. Band width is 18 inches. This inner band is placed on a 28"×28"×18" collapsible shell and the middle band is formed by wrapping over the inner band with 45 wraps of the fabric 28" wide. The open faces not covered by the inner band are covered by the wrapping of the middle band. After two wraps, 26 inch squares of polyethylene sheet (0.125 inch thick) are affixed to the two square sides of the middle band. The inner and middle bands are sewn together along their edges and a 27 inch slit is cut along the center line of one of the exposed faces of the inner band. The outer band is created by winding a 28 inch wide strip forty-five (45) times around the combined inner and middle band to cover the slit. Each face of the container has the areal density of two of the three bands. Both edges of the outer band are sewn with overcast stitching and when the outer band is removed it is sewn across the band width to keep both the beginning and end of the strip in place.

A plastic zipper is sewn into the slit in the inner band. This container is collapsible and estimated to weigh 58 lb.

Container 4 of this example is constructed from an inner Spectra 1000 fabric band and middle and outer bands of a tape consisting of three layers of Spectra 1000 parallel fiber webs in a KRATON D1107 matrix oriented 0/90/0 with 80 wt. % fiber. This tape is essentially a SpectraShield PCR with a layer of uni-tape laminated onto it and will be referred to as 0/90/0 tape. The inner and middle bands are attached to each other and the inner band has a 23-inch slit in the middle of one long side. Inside container dimensions are 15"×14"×24". The slit is at the top of the container and the inner band is 14 inches deep. Container weight is estimated to be 105 lb.

The inner band is wrapped around a rectangular mandrel which has side lengths of 14 and 24 inches. Spectra 1000 fabric (Clark-Schwebel style 955, 55×55 plain weave, 215 denier/60 filament yarn, areal density of 0.112 kg/m$^2$) is wrapped with a fabric width of 21 inches. After two wraps a conventional SpectraShield consolidated panel 14"×23" is centered on one long side and fixed in place with double stick tape. This panel is estimated to weigh 5 lb. and is molded at force of 30 tons for 30 minutes at 125 C. in a hydraulic press. Fabric wrapping continues until one-half of the desired wraps are obtained. Wrapping is then continued using a strip of fabric which is 15 inches wide, centered on the 21 inch strip. A 23 inch long slit is cut into the long side not containing the SpectraShield panel. Flaps, 3 inches wide, are made on both sides of the band after overcast stitching of the two edges. The total weight of the fabric in band 1 is estimated to be 32 lb. The middle band is constructed by winding a 15 inch wide strip of 0/90/0 tape around a rectangular mandrel 15"×24" to achieve a band weight of 34 lb. Polyethylene film is wrapped around the band and the band plus mandrel is placed in a hydraulic press to consolidate two of the four sides. The orientation of the mandrel is changed and the procedure repeated to consolidate the other two sides. The outer band is constructed by winding a 15 inch wide strip of 0/90/0 tape around a rectangular mandrel approximately 17.5"×16" to achieve a band weight of 34 lb. Polyethylene film is wrapped around the band and the band plus mandrel is placed in a hydraulic press to consolidate two of the four sides. The orientation of the mandrel is changed and the procedure repeated to consolidate the other two sides. A zipper is sewn in to the slit in the inner band, and the inner band is attached to the middle band at the corners and the middle of the edges using elastic straps. The combined middle and inner bands can easily be pushed into and pulled out of the outer band.

Containers 1 and 2 were tested as follows:

For Container 1, a pipe bomb was placed in the geometric center of the container, surrounded by ziplock polyethylene bags filled with BARBASOL® brand shaving cream (density of foam about 0.053 g/c$^3$, blowing agent isobutane), commercially available from Pfizer Inc. Detonation caused considerable damage to the container, but the container remained intact. Examination of the outer faces indicated that four pieces of shrapnel escaped and could have done damage. The outer band showed rips at three of the four edges of 11, 12 and 16 inches characteristic of blast alone. Examination of the container interior indicated that it was filled with metal fragments and five large pieces threaded at both ends, three of which were 0.75 inch wide, one of which was 1.0 inch wide, and one of which was 1.50 inches wide. Summing the width of these large pieces and comparing that width with the pipe diameter indicated that 75% of the pipe was accounted for in the five pieces. A large number of small pieces, including pieces from the end caps, was either loose in the interior or embedded in the container walls.

Although some fragments escaped, most of the fragments were captured, no shock wave of any consequence was propagated, and the container itself did not contribute to shrapnel. Bomb fragments, the detonator and detonator wire were retrieved and could be further examined to obtain evidence in criminal pipe bomb incident.

Container 2 was tested in a similar fashion. One fragment penetrated the outer wall of this container. There was no ripping of the edges. Note that there is variability with regard to fragments generated from a pipe bomb. Clearly an increase in areal density would provide greater protection.

It is anticipated that Container 3 will provide complete protection against 1 lb. of C4 placed at the geometric center of the container, when the container is filled with aqueous foam of density 0.05 g/cm$^3$.

It is anticipated that Container 4 would provide complete protection against both the blast and fragments from a modified M67 hand grenade and a pipe bomb similar to the one used to test Containers 1 and 2 (with pipe length increased to 10 inches and powder charge correspondingly increased).

Conclusions

It can be seen that the slit does not affect the major function of the band in which it is cut, i.e., to bear the load in the direction along the continuous fibers. The presence of the slit permits insertion of relatively big objects inside of preassembled pairs of bands. This eliminates an extra handling step—nesting a first band within a second after placing a blast-prone object inside the first band. This makes use of the container safer and more user friendly. It saves precious time.

Also, with the flexible designs, a combined three dimensional distortion of the several faces can transform a slit boundary into a rectangular opening through which a parallelpiped-shaped object can be placed (in-cabin on board luggage, a brief case, etc.). The object can have relatively large dimensions compared to the dimensions of the blast container. The required flexibility of the face material is readily achieved in the container where the bands are created from fabric. In this case the required flexibility can be controlled by the degree of sawing/quilting the fabric layers and inserting rigid elements along the ribs where it is required. Rods permitting large deflection (flexible rods or rods with strategically positioned hinge elements) can be inserted along some ribs. Such rods can be required along the ribs bordering the plane with the slit.

We claim:

1. A container assembly for receiving an explosive, comprising:

a. a container, said container having an access opening; and b. a band of blast resistant material encircling said container to substantially cover said access opening, said material being selected from the group consisting of oriented film(s), fibrous layer(s) and combinations thereof, said band having at least one slit therethrough which can be aligned with a portion of the access opening for access therethrough to the interior of the container, said slit having a length dimension parallel to the hoop direction of the band.

2. The container assembly of claim 1 wherein said container comprises another band of blast resistant material nested within the band having the slit, said nested band having a foldable flap on each side thereof.

3. The container assembly of claim 2 wherein said bands are attached to one another.

4. The container assembly of claim 1 wherein said blast resistant material comprises at least one fibrous layer, said fibrous layer comprising at least one network of high strength fibers having a tenacity of at least about 10 g/d and a tensile modulus of at least about 200 g/d, at least about 50 weight percent of said fibers being substantially continuous, parallel lengths of fiber in the hoop direction of the band.

5. The container of claim 1 wherein said material comprises at least one oriented film.

6. The container of claim 5 wherein said oriented film is selected from the group consisting of homopolymers and copolymers of thermoplastic polyolefins, thermoplastic elastomers, crosslinked thermoplastics, crosslinked elastomers, polyesters, polyamides, fluorocarbons, urethanes, epoxies, polyvinylidene chloride, polyvinyl chloride, and blends thereof.

7. The container of claim 5 wherein said oriented film is selected from the group consisting of high density polyethylene, polypropylene, and polyethylene/elastomeric blends.

8. A container for receiving an explosive, said container comprising at least two bands of blast resistant material, said material being selected from the group consisting of oriented film(s), fibrous layer(s) and combinations thereof, a first inner band nested within a second band and oriented so as to substantially enclose a volume therewith, at least one of said bands having at least one slit therethrough for access into said container, said slit having a length dimension parallel to the hoop direction of the band in which located.

9. The blast resistant container of claim 8 wherein said bands are attached to one another.

10. The blast resistant container of claim 8 further comprising an outer band of blast resistant material in which said second band nests, said bands together forming a container wall having a thickness substantially equivalent to the sum of the thicknesses of at least two of the bands, said outer band being a continuous, slit-free band.

11. The blast resistant container of claim 8 further comprising blast mitigating material located within the first inner band.

12. The container assembly of claim 8 wherein said blast resistant material comprises at least one fibrous layer, said fibrous layer comprising at least one network of high strength fibers having a tenacity of at least about 10 g/d and a tensile modulus of at least about 200 g/d, at least about 50 weight percent of said fibers being substantially continuous, parallel lengths of fiber in the hoop direction of the band.

13. The container of claim 8 wherein said material comprises at least one oriented film.

14. The container of claim 13 wherein said oriented film is selected from the group consisting of homopolymers and copolymers of thermoplastic polyolefins, thermoplastic elastomers, crosslinked thermoplastics, crosslinked elastomers, polyesters, polyamides, fluorocarbons, urethanes, epoxies, polyvinylidene chloride, polyvinyl chloride, and blends thereof.

15. The container of claim 13 wherein said oriented film is selected from the group consisting of high density polyethylene, polypropylene, and polyethylene/elastomeric blends.

16. A blast resistant container assembly for receiving an explosive, said container assembly comprising:

a. at least three seamless bands of a blast resistant material comprising high strength fibers having a tenacity of at least about 10 g/d and a tensile modulus of at least about 200 g/d, said bands being nested one within the other when assembled with their longitudinal axes at right angles to one another to substantially enclose a volume and to form a container wall having a thickness substantially equivalent to the sum of the thicknesses of at least two of the bands, at least one of said bands nested within another band having at least one slit therethrough for access into said volume, said slit having a length dimension parallel to the hoop direction of the band in which it is located; and b. an aqueous foam located within said volume, said foam having a density in the range of from about 0.01 to about 0.10 g/cm$^3$.

* * * * *